US009033296B1

(12) United States Patent
Richards et al.

(10) Patent No.: US 9,033,296 B1
(45) **Date of Patent: *May 19, 2015**

(54) MULTI-PURPOSE DRAPERY ROD ASSEMBLY

(71) Applicants: Jeniece Mayhugh Richards, Las Vegas, NV (US); Clinton Henry Richards, Las Vegas, NV (US)

(72) Inventors: Jeniece Mayhugh Richards, Las Vegas, NV (US); Clinton Henry Richards, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/892,002

(22) Filed: May 10, 2013

Related U.S. Application Data

(62) Division of application No. 13/385,041, filed on Jan. 30, 2012, now Pat. No. 8,479,931.

(51) Int. Cl.
*A47H 1/10* (2006.01)
*A47H 1/02* (2006.01)

(52) U.S. Cl.
CPC ..... *A47H 1/02* (2013.01)

(58) Field of Classification Search
CPC ..... A47H 1/02; A47H 1/00; A47H 1/022; A47H 1/03; A47H 1/13; A47G 25/06; A47G 29/10
USPC ..... 248/251, 261, 263–269, 271, 272
See application file for complete search history.

(56) References Cited

U.S. PATENT DOCUMENTS

| | | | | |
|---|---|---|---|---|
| 999,675 | A * | 8/1911 | Schmitz | 248/261 |
| 1,510,294 | A * | 9/1924 | Bertrand | 248/218.1 |
| 1,948,734 | A * | 2/1934 | Rosenberg | 248/263 |
| 2,269,738 | A * | 1/1942 | Rybicky | 248/265 |
| 2,602,499 | A * | 7/1952 | Hyman | 160/19 |
| 2,894,710 | A * | 7/1959 | Shields | 248/265 |
| 3,766,597 | A | 10/1973 | Ford | |
| 3,881,218 | A | 5/1975 | Palmer | |
| 3,946,978 | A * | 3/1976 | Evans | 248/264 |
| 4,120,474 | A | 10/1978 | Hurley | |
| 4,140,294 | A | 2/1979 | Zwarts | |
| 4,179,091 | A | 12/1979 | Bidney | |
| 4,465,198 | A | 8/1984 | Martin | |
| 4,978,094 | A | 12/1990 | Ford | |
| 5,259,520 | A | 11/1993 | Roggio | |
| 5,529,520 | A | 6/1996 | Iwashita | |
| 6,367,755 | B1 * | 4/2002 | Arena | 248/251 |
| 6,382,295 | B1 | 5/2002 | Nicholson | |
| 6,499,708 | B1 | 12/2002 | Cowen | |
| 7,322,552 | B1 | 1/2008 | Lin | |
| 7,360,576 | B2 | 4/2008 | Lin | |
| 7,370,839 | B2 * | 5/2008 | Putman | 248/262 |
| 7,648,111 | B2 | 1/2010 | Goldstein | |
| 7,861,989 | B2 | 1/2011 | Cross | |
| 8,479,931 | B1 * | 7/2013 | Richards et al. | 211/105.2 |

(Continued)

*Primary Examiner* — Gwendolyn W Baxter

(57) ABSTRACT

The multi-purpose drapery rod assembly uses unique rod and bracket construction to provide a superior platform for both single and layered drapery. A single-drapery rod cooperates with bracket to attach to surfaces at nearly any angle, and is easily converted to either a Type 1 dual-drapery rod which layers accent drapery to the side and in front of primary drapery without a view-obstructing front rod, or to a Type 2 dual-drapery rod which layers fully-drawable primary drapery in front and to the sides of secondary drapery. Types 1 and 2 are easily converted to the other due to modular construction. Both display drapery from the back, front, and along the sides by connecting the back and front with curved sections between them. The assembly can also be motorized, connecting to an existing traverse rod and converting to a dual-drapery rod when desired.

20 Claims, 30 Drawing Sheets

(56) References Cited

U.S. PATENT DOCUMENTS

2002/0162929 A1* 11/2002 Downey et al. ..... 248/262
2001/0628777 7/2006 Chou
2009/0308995 A1* 12/2009 Kuo ..... 248/231.91
2013/0099080 A1* 4/2013 Baines ..... 248/262
2013/0341474 A1* 12/2013 Baines ..... 248/208

* cited by examiner

MULTI-PURPOSE DRAPERY ROD ASSEMBLY

CROSS-REFERENCE TO RELATED APPLICATIONS

This is a divisional application claiming the filing date of parent application Ser. No. 13/385,041 filed Jan. 30, 2012. The divisional application contains only subject matter disclosed in the parent application, which is hereby incorporated by reference.

BACKGROUND OF THE INVENTION

1. Field of the Invention

The present invention generally relates to window drapery hardware, and more specifically to drapery rods and their mounting brackets.

2. Prior Art

Drapery is used as a window enhancement for decorative purposes as well as for insulation, to provide privacy, and to control natural light. Drapery rods of a variety of shapes and sizes have been designed to support drapery or the structures to which the drapery is attached. Traverse rods, for example, are rectangular and hold drapery pins and hooks while drapery rings are frequently used with circular rods. The rods may consist of a single bar or a plurality of typically telescoping bars, and like the drapery they support, may be designed for aesthetic appeal as well as functionality Designers and inventors have adorned the rods with decorative hardware, modified their surfaces, used attractive materials, and created innovative methods of enhancing aesthetics while maintaining functionality U.S. Pat. No. 6,499,708 and U.S. Pat. No. 5,259,520, for example, offer rods that function smoothly despite the presence of decorative material on their surface, U.S. Pat. No. 3,730,249 conceals center-support brackets, and U.S. Pat. No. 3,881,218 allows the use of plastic materials while maintaining the aesthetic features that have been designed for drapery rods.

Drapery rods are most often mounted to a substantially parallel vertical support surface such as a wall. A first member base plate typically engages the wall while a third member engages the rod with what is generally some sort of clip or socket structure. A second member connects the two, establishes the distance between the wall and the rod, and may engage the under surface of the rod. The needs for easy horizontal adjustment of the second member and vertical adjustment of the base plate have long been addressed by inventors in the industry (e.g., U.S. Pat. No. 4,140,294 and U.S. Pat. No. 4,179,091). More recently, inventors have turned their attention to making brackets more adaptable rather than more adjustable. U.S. Pat. No. 6,382,295 offers a bracket adaptable to either mini-blinds or curtain rods, and U.S. Pat. No. 7,322,552 offers one adaptable to both the roman shade and the crisscross curtain singularly and in combination. Another recent invention, U.S. Pat. No. 7,861,989, offers a bracket which can mount to a wall, ceiling, or opposing surfaces by adding or removing some parts of the bracket. This is significant since the mounting of a rod to opposing surfaces previously required a bracket like U.S. Pat. No. 3,946,978 quite different from those used for ceiling or wall mounting. However, a multi-purpose bracket that does not require parts to be changed out for different surfaces would be preferred, and for reasons to be described, a multipurpose bracket is also needed that prevents circular rods from rotating. U.S. Pat. No. 7,861,989 does not fulfill these needs.

Inventors have achieved considerable success in improving the aesthetics of single-drapery rods and the functionality of mounting brackets, with some noted limitations, but the layering of drapery continues to be plagued by long standing problems. These problems are inherent in the standard double-traverse rod and the generally more decorative double rod and bracket system used for layering drapery. The standard double-traverse system supports two parallel traverse rods behind aesthetically unappealing front and side panels. The double rod and bracket system consists of two parallel traverse or non-traverse rods with exposed ends supported by a double-bracket. For aesthetic reasons, the ends of the rods are often adorned with expensive hardware and the double brackets are often decoratively constructed. Both the standard double-traverse rod and the double rod and bracket system are used to layer primary drapery in front of what is typically sheer secondary drapery, but the more decorative double rod and bracket system is favored when layering secondary accent drapery in front of primary drapery. It, too, has aesthetic problems however. The front rod may be made in a variety of appealing shapes and colors, often at great expense, but it still unnecessarily obstructs the view of the primary drapery. And the exposed ends of the two rods and the gaps between them are difficult if not impossible to make aesthetically appealing, particularly when viewed from the side.

The aesthetic problems encountered in supporting layered drapery have led the industry to market extensive and expensive collections of decorative hardware; designers to use additional drapery to hide the ends of the rods and the gaps between them; and contractors to build custom valences in front and to the side of the rods. The approaches are costly and fail to solve the inherent problems they try to hide. Inventors have likewise failed to develop an aesthetically appealing alternative support structure that layers drapery without the need for an obtrusive front rod, aesthetically unappealing panels, or the exposed ends of two rods. U.S. Pat. No. 7,648,111 allows additional drapery rods to be supported on the main brackets of a main drapery rod installation and U.S. Pat. No. 4,120,474 offers a bracket which can be adapted to support a single or double drapery rod, but although both ease installation concerns, they maintain the essential features of the double rod and bracket system. U.S. Pat. No. 3,766,597 and U.S. Pat. No. 4,978,094 offer intrinsically different systems, but are not appropriate for layering accent drapery in front of primary drapery or for layering primary drapery in front of secondary drapery. U.S. Pat. No. 3,766,597 provides a single aesthetically appealing rod which encases two rods, but their close proximity is inappropriate for the layering of drapery. U.S. Pat. No. 4,978,094 suffers a similar problem, arraying multiple rods in an inappropriate spatial relationship of close vertical and horizontal proximity. The resulting unsatisfied desire to layer accent drapery to the side and in front of primary drapery without a view-obstructing front rod has led some in desperation to hang accent drapery to the side and on the same rod as primary drapery, but this too obviously fails to provide an appropriately layered look.

A dual-drapery rod is needed which layers accent drapery to the side and in front of primary drapery without an obtrusive front rod and without the exposed ends of two rods or unattractive front and side panels to mar the aesthetic appeal of the drapery. The aim is to display the drapery—not the rods. A dual-drapery rod is also needed which layers fully drawable primary drapery in front of secondary drapery. Ideally one type of dual-drapery rod would be easily assembled from the other or from an existing single-drapery rod.

A single-drapery rod assembly is also needed that can be easily mounted to a ceiling or to a parallel or opposing vertical support surface using an inconspicuous bracket requiring little or no modification to adapt to differently-angled support surfaces.

Another need relates to the motorization of drapery rods. Electric remote controlled mechanisms for operating traverse rods have appeared on the market in increasing numbers of late, but the functionally effective ones are expensive and difficult to install. The small light-weight motors deemed necessary are themselves very expensive, and few can be attached to an existing rod.

Operational inefficiency has also been a problem. US 2006/0162877 A1 and U.S. Pat. No. 7,360,576 B2 can be attached to existing traverse rods, and the latter does improve the functioning of the drive pulley with a more complex double wheel system. But the performance of both inventions, like that of previous art, is still hindered by redirections of the traverse rod's transmission cord. The cord is redirected from a horizontal direction to a vertical one before engaging the drive pulley system, then redirected back from vertical to horizontal before returning to the traverse rod. Structural complexity and cost are increased as well as wear and tear and slippage of the transmission cord. Operational efficiency and effectiveness continue to decrease over time as the cord becomes smoother and smoother. A motorized assembly is needed which is structurally simpler, does not require the redirection of transmission cords done in prior art, is easy to install on existing traverse rods, and can support and utilize a relatively inexpensive motor effectively and aesthetically.

The present invention offers a multi-purpose drapery rod assembly which provides a superior platform for single and layered drapery that is easily convertible from one to the other and is made possible by unique rod and cooperating bracket construction. The single-drapery rod has a flexible bracketing system which can attach the rod to not only substantially parallel support surfaces such as walls, but also to ceilings and to opposing support surfaces such as those found with recessed windows. The ends of the rod can also be attached at different heights on opposed or parallel vertical support surfaces, making it adaptable to non-rectangular windows, recessed or not. The single-drapery rod is easily converted to a dual-drapery rod which provides a continuous platform for drapery from the back to the front, thereby eliminating the need for side panels or the display of the exposed ends of a separate front and back rod. The dual-drapery rod doesn't require a view-obstructing front bar when layering accent drapery in front of primary drapery but does provide one for layering primary drapery in front of what is typically sheer or more translucent secondary drapery. The back, front, and curved sections which connect the substantially straight front and back sections are secured in a horizontal plane by unique brackets which unobtrusively but efficiently and effectively engage the rod and support surfaces.

The present invention also provides a motorized assembly which can be attached to an existing traverse rod and integrated with a dual-drapery rod when desired. The easy to install assembly is structurally simple, does not require redirection of transmission cords, and can aesthetically and more effectively utilize a bigger and heavier but less expensive motor than available alternatives.

3. Objects and Advantages

The multi-purpose drapery rod assembly offers:

1) a dual-drapery rod assembly comprised of a uniquely constructed dual-drapery rod and bracket, which cooperate to more aesthetically and economically layer primary and secondary drapery;
2) modular Type 1 and Type 2 embodiments that layer drapery from the front, back, and sides and easily convert from one to the other, Type 1 rods layering accent drapery in front of primary drapery without an obstructing front rod and Type 2 rods layering secondary drapery behind fully drawable primary drapery;
3) modular Type 1 and Type 2 embodiments that easily convert existing engageable single-drapery rods into dual-drapery rods;
4) a single-drapery rod with unique cooperating mounting brackets that can be inconspicuously affixed to surfaces lying at nearly any angle to the rod;
5) modular embodiments that easily convert this unique single-drapery rod into Type 1 or Type 2 embodiments;
6) and a conversion assembly that motorizes a single traverse rod and can convert it into a dual-drapery rod when desired.

SUMMARY

The multi-purpose drapery rod assembly provides an improved single-drapery rod assembly with a flexible bracketing system which can attach the rod to substantially parallel support surfaces such as walls, to ceilings, or to opposing support surfaces such as those found with recessed windows. The ends of the rod can also be attached at different heights on opposed or parallel vertical support surfaces, making the rod adaptable to non-rectangular windows whether or not they are recessed.

The multi-purpose drapery rod assembly also provides components which can convert the single-drapery rod assembly, or any telescopically compatible single-drapery rod, into a dual-drapery rod assembly. The dual drapery rod assembly layers drapery by 1) supporting it on the front, back, and sides, thereby eliminating the need to expose the ends of two separate rods or cover them with side panels; and 2) makes a view-obstructing front bar unnecessary when layering accent drapery in front of primary drapery but provides one for layering fully drawable primary drapery in front of secondary drapery. The dual-drapery rod is secured in a horizontal plane by brackets which attach easily and unobtrusively to a support surface and the rod.

Finally, the multi-purpose drapery rod assembly offers a conversion assembly which motorizes a traverse rod and converts it into a dual-drapery rod when desired.

DRAWINGS

Together with the detailed description, the accompanying drawings serve to explain and illustrate the principles and implementations of the multi-purpose drapery rod assembly and make its nature, objects, and advantages more apparent to those skilled in the art. The drawings, although not drawn to scale, illustrate multiple embodiments of the single-drapery rod as well as the Type 1 and Type 2 dual-drapery rod embodiments. Also shown are two embodiments of adjustable and non-adjustable mounting brackets, as well as a motorized conversion assembly.

Figure 1A:
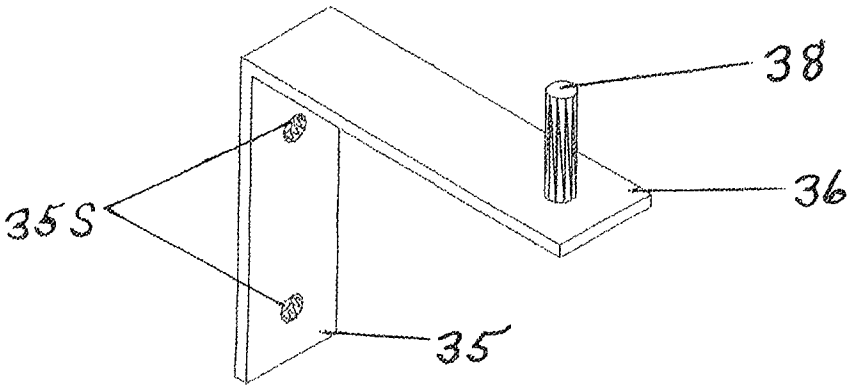
FIG. 1A is a perspective view from above of the preferred non-adjustable wall mounting bracket of the multi-purpose drapery rod assembly.
Figure 2A:
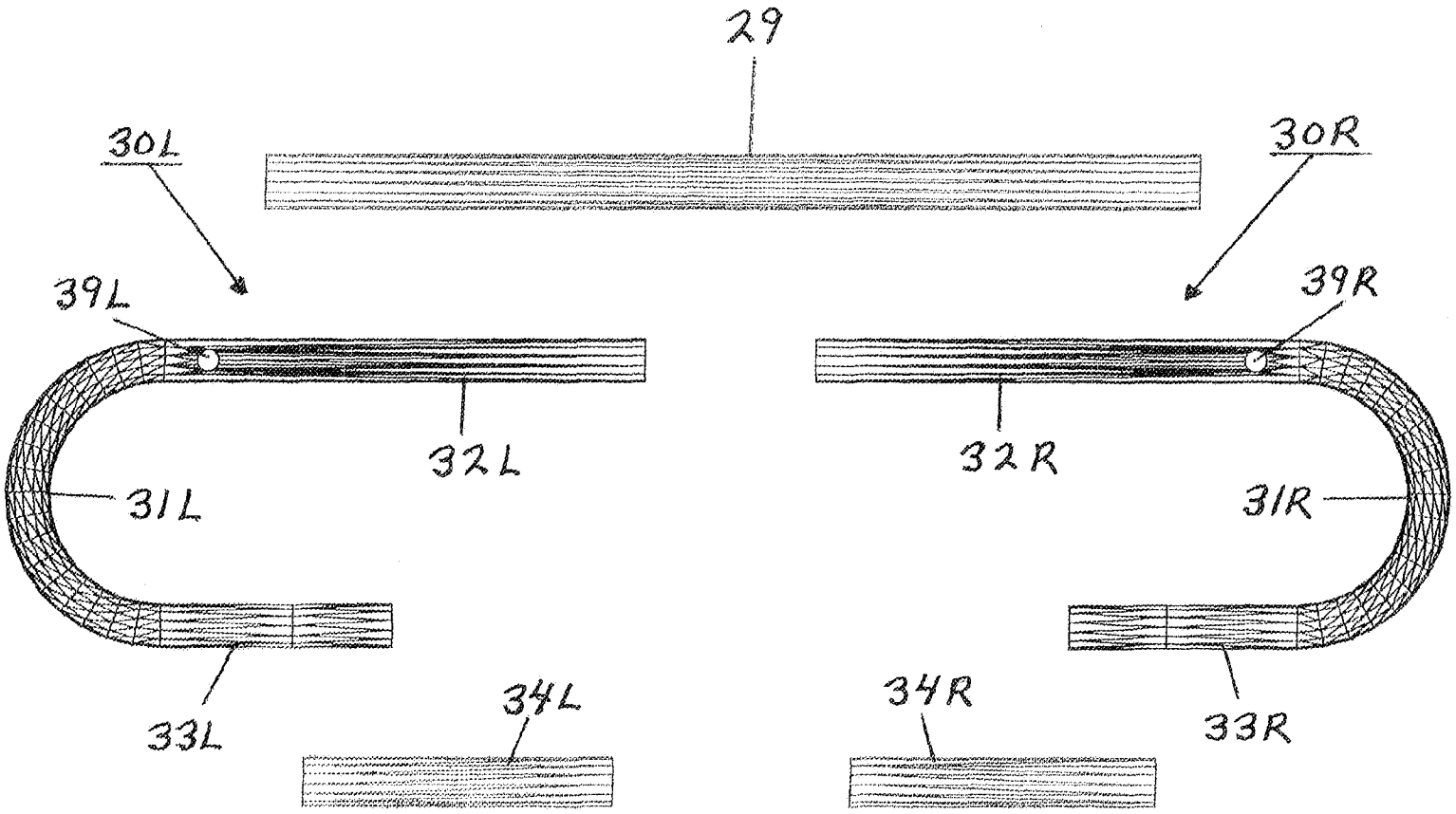
FIG. 2A is a top view of the preferred configuration of component rods that assemble into a Type 1 dual-drapery rod designed to layer accent drapery in front and to the side of primary drapery.

FIG. 2AA is a perspective view from above of the component rods shown in FIG. 2A telescoped together and mounted on a (not shown) wall or other substantially vertical support surface using the preferred non-adjustable bracket of FIG. 1A.

Figure 2A:
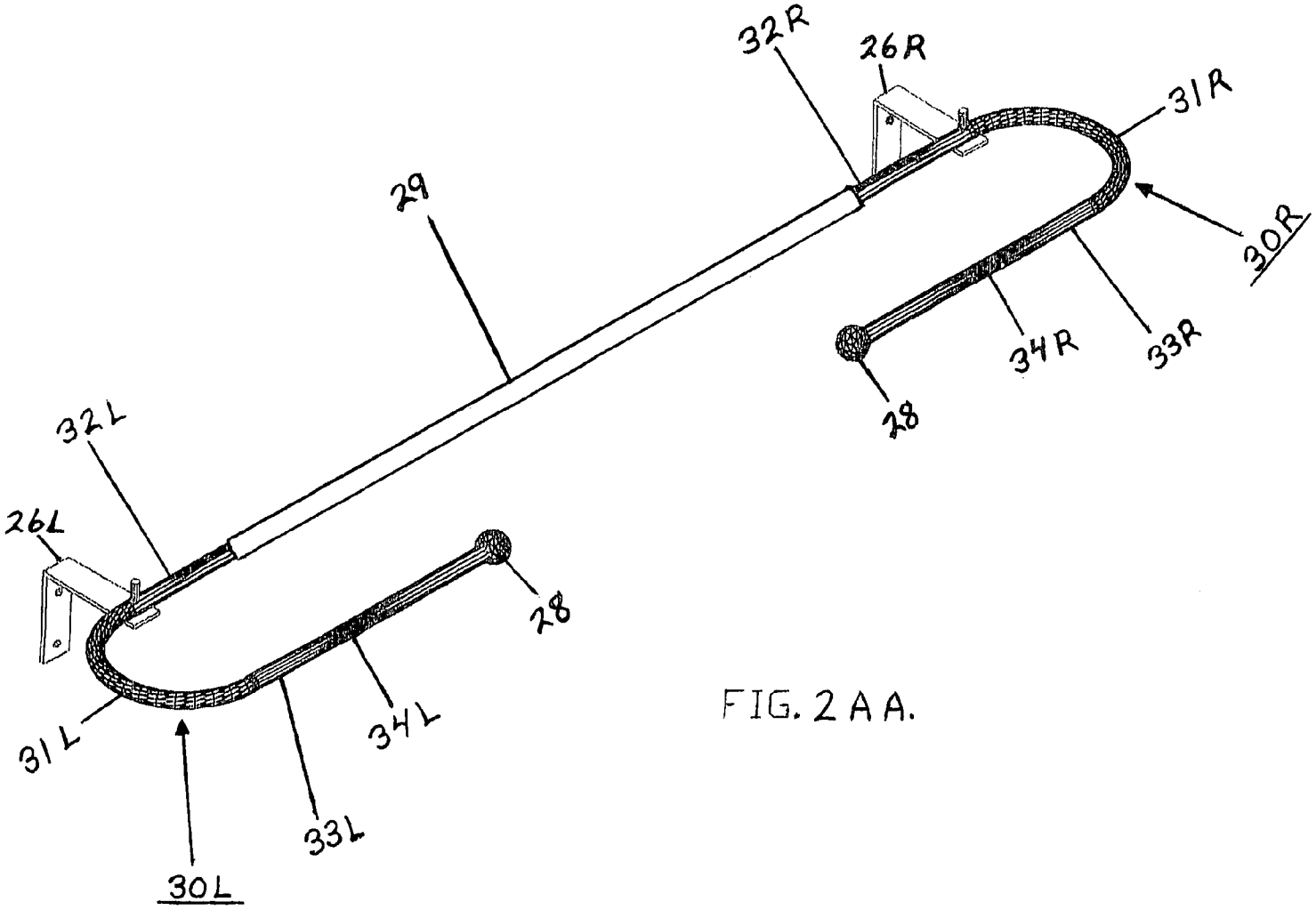
Figure 2B:
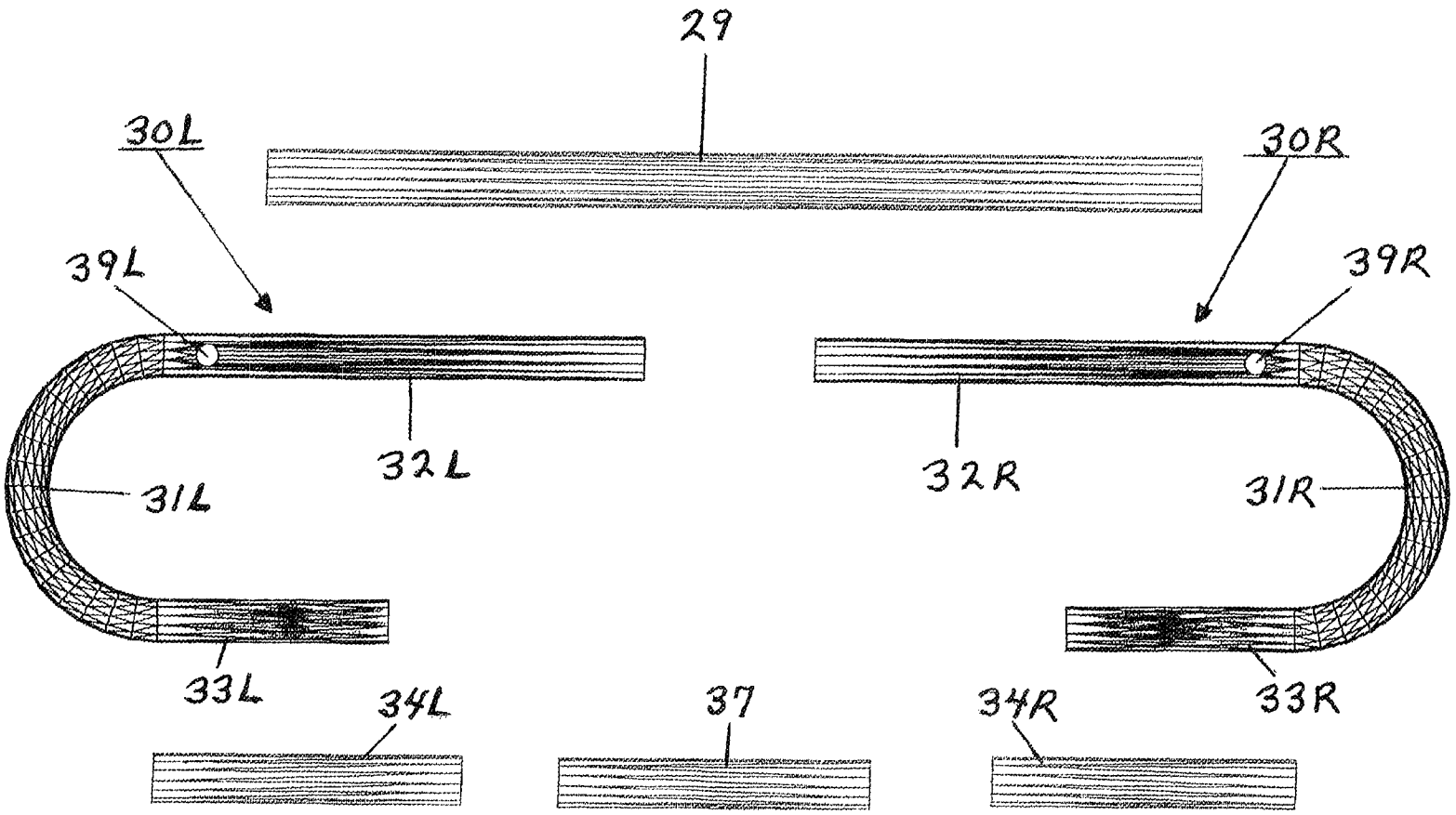

FIG. 2B is a top view of the preferred configuration of component rods that assemble into a Type 2 dual-drapery rod to layer primary drapery in front and to the side of secondary drapery.

Figure 3A:
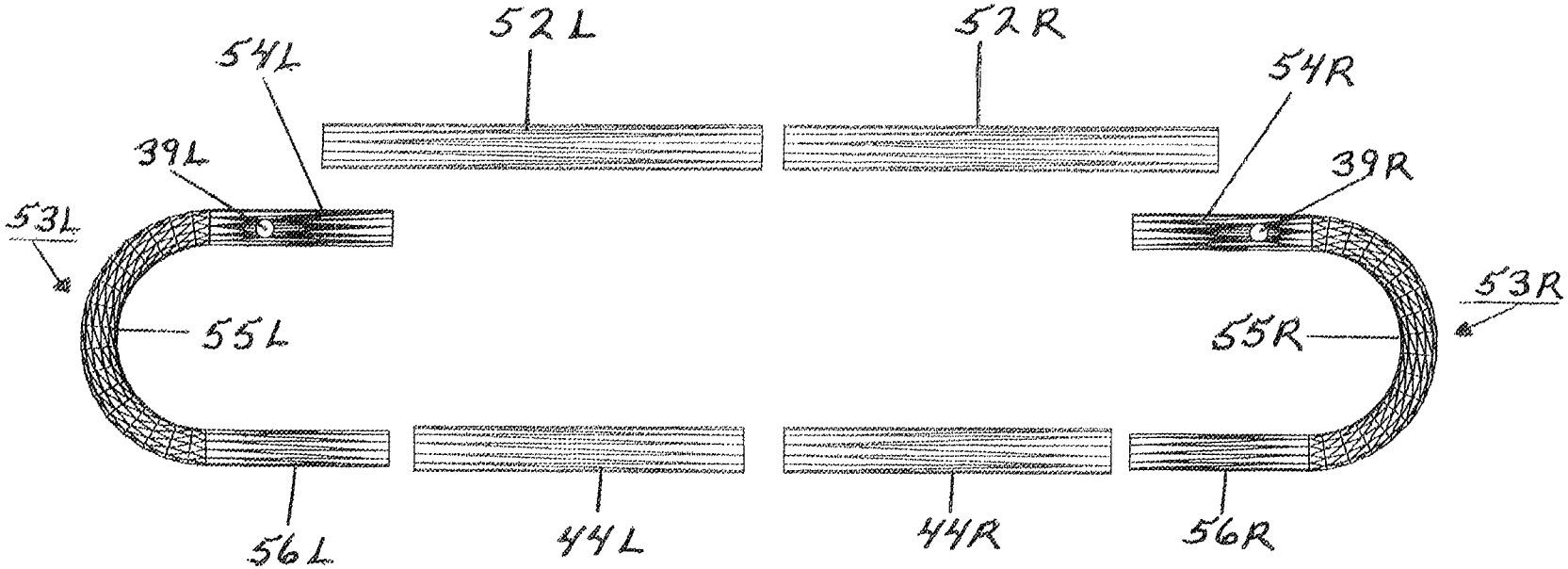

FIG. 3A is a top view of the component rods of a second Type 1 embodiment that includes a single-drapery rod.

Figure 3B:
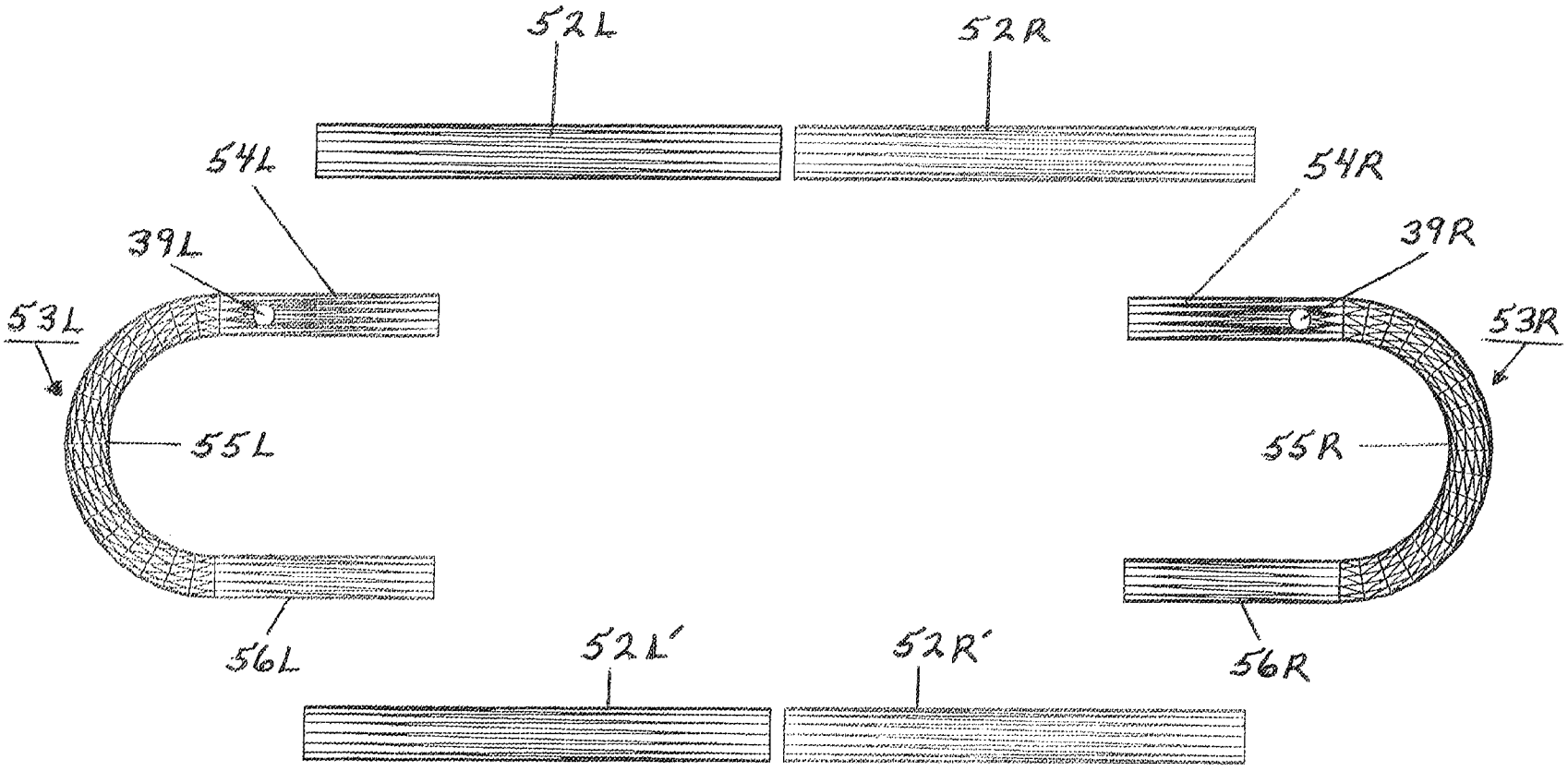

FIG. 3B is a top view of the component rods of a second Type 2 embodiment that includes a single-drapery rod.

Figure 4A:
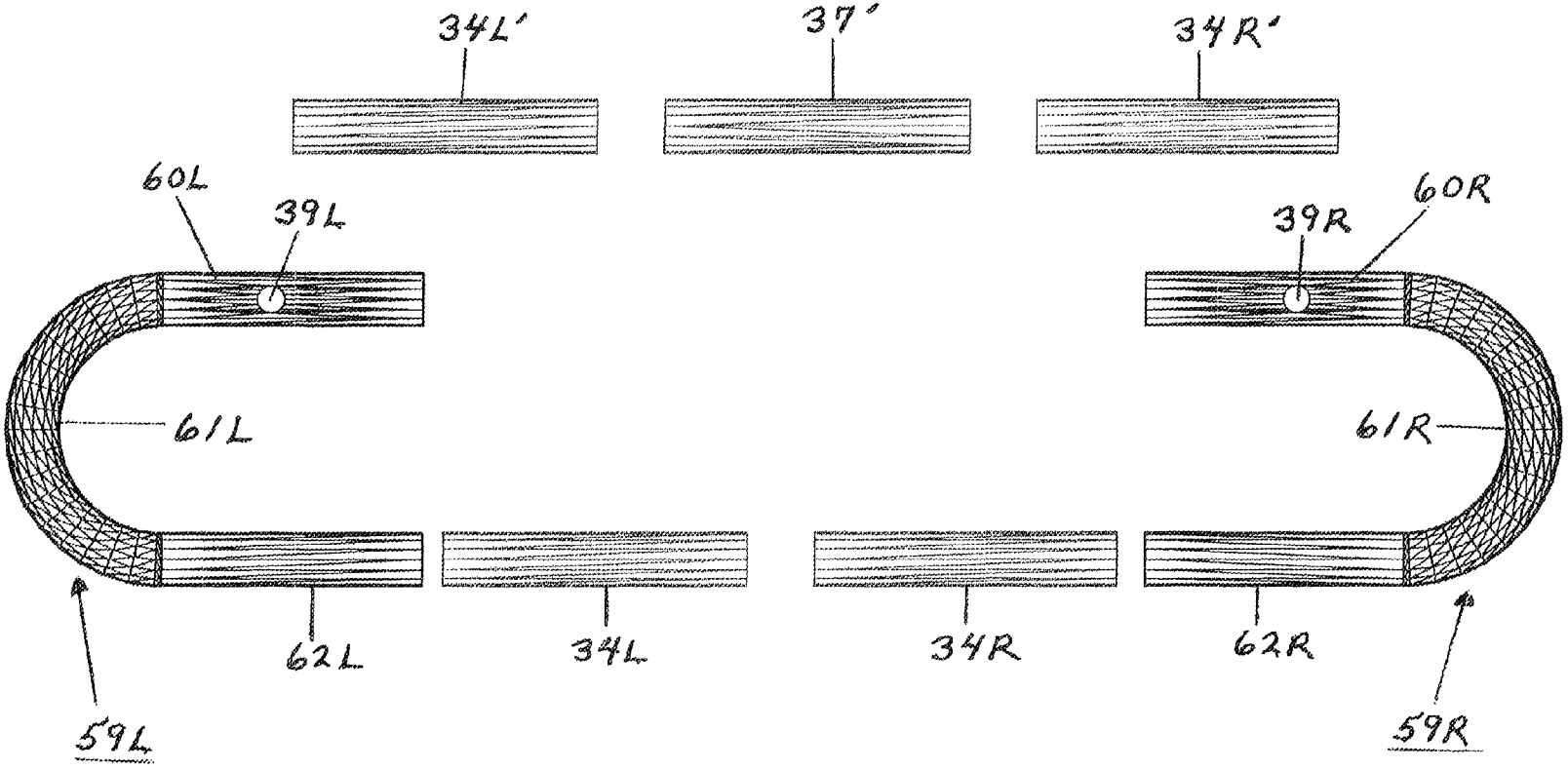

FIG. 4A is a top view of the primary components of a third Type 1 embodiment that includes a single-drapery rod.

Figure 4B:
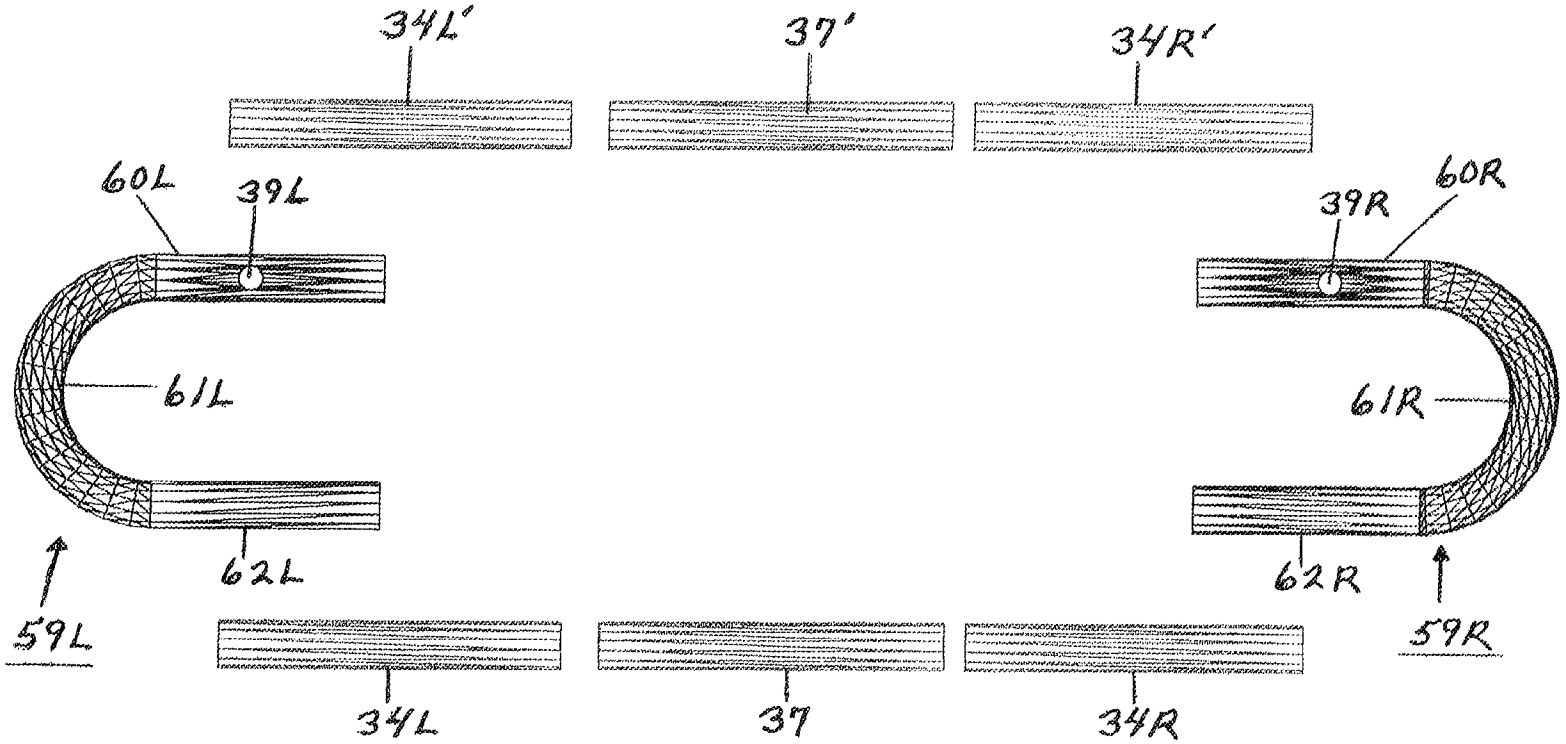

FIG. 4B is a top view of the component rods of a third Type 2 embodiment that includes a single-drapery rod.

Figure 5:
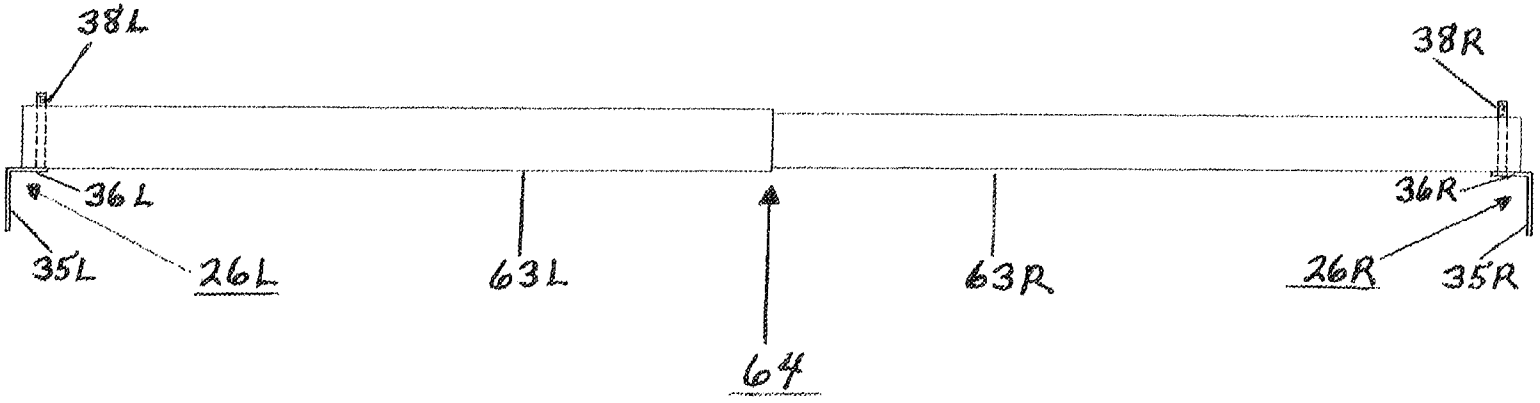

FIG. 5 is a side view of the preferred embodiment of the single-drapery rod mounted on opposing vertical support surfaces.

Figure 6:
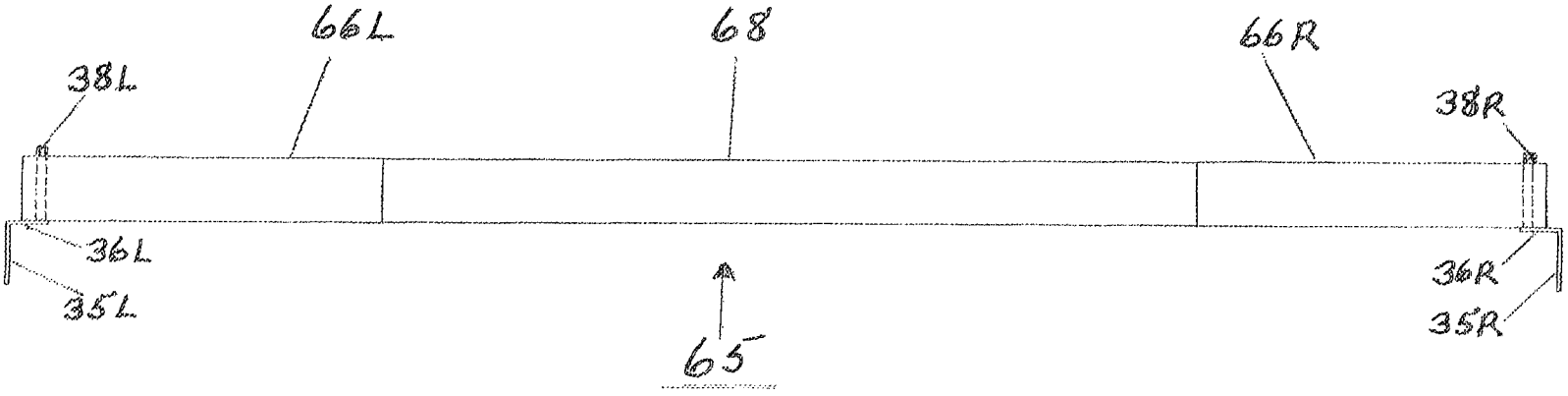

FIG. 6 is a side view of a second embodiment of the single-drapery rod mounted on opposing vertical support surfaces.

Figure 7:
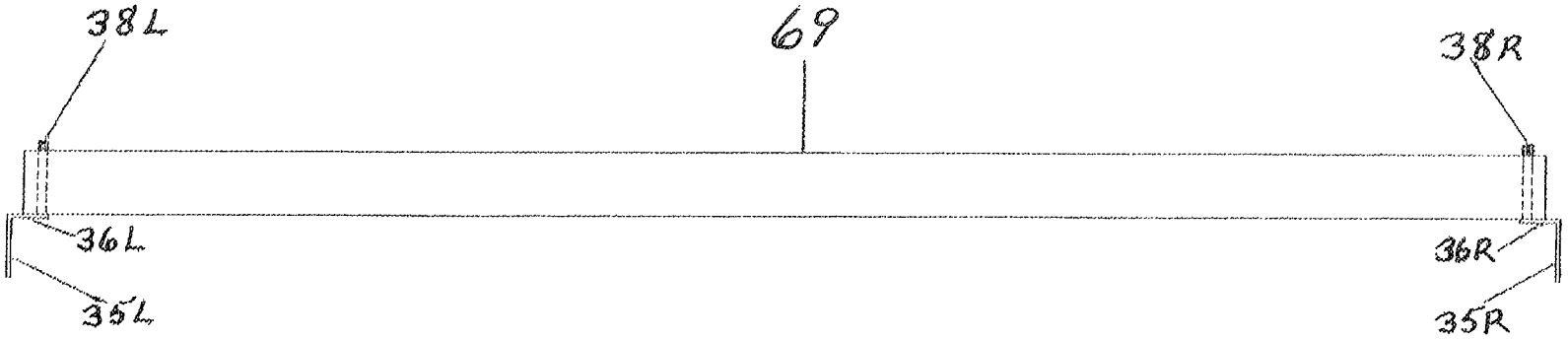

FIG. 7 is a side view of a single-drapery rod comprised of a single rod rather than a plurality of telescoping rods mounted on opposing vertical support surfaces.

Figure 8:
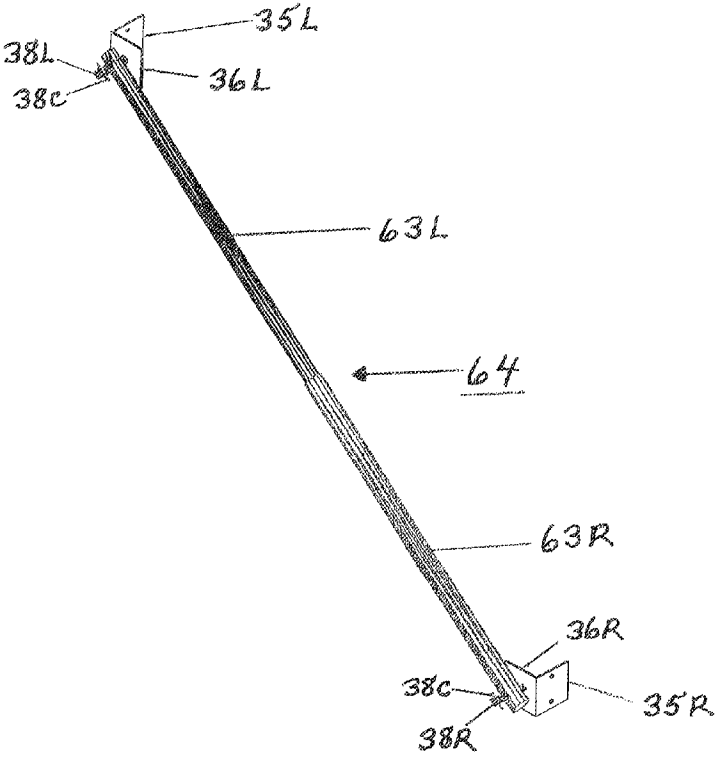

FIG. 8 is a perspective view from above and to the right of the preferred embodiment of the single-drapery rod mounted to opposing surfaces at a substantially non-perpendicular angle.

Figure 9A:
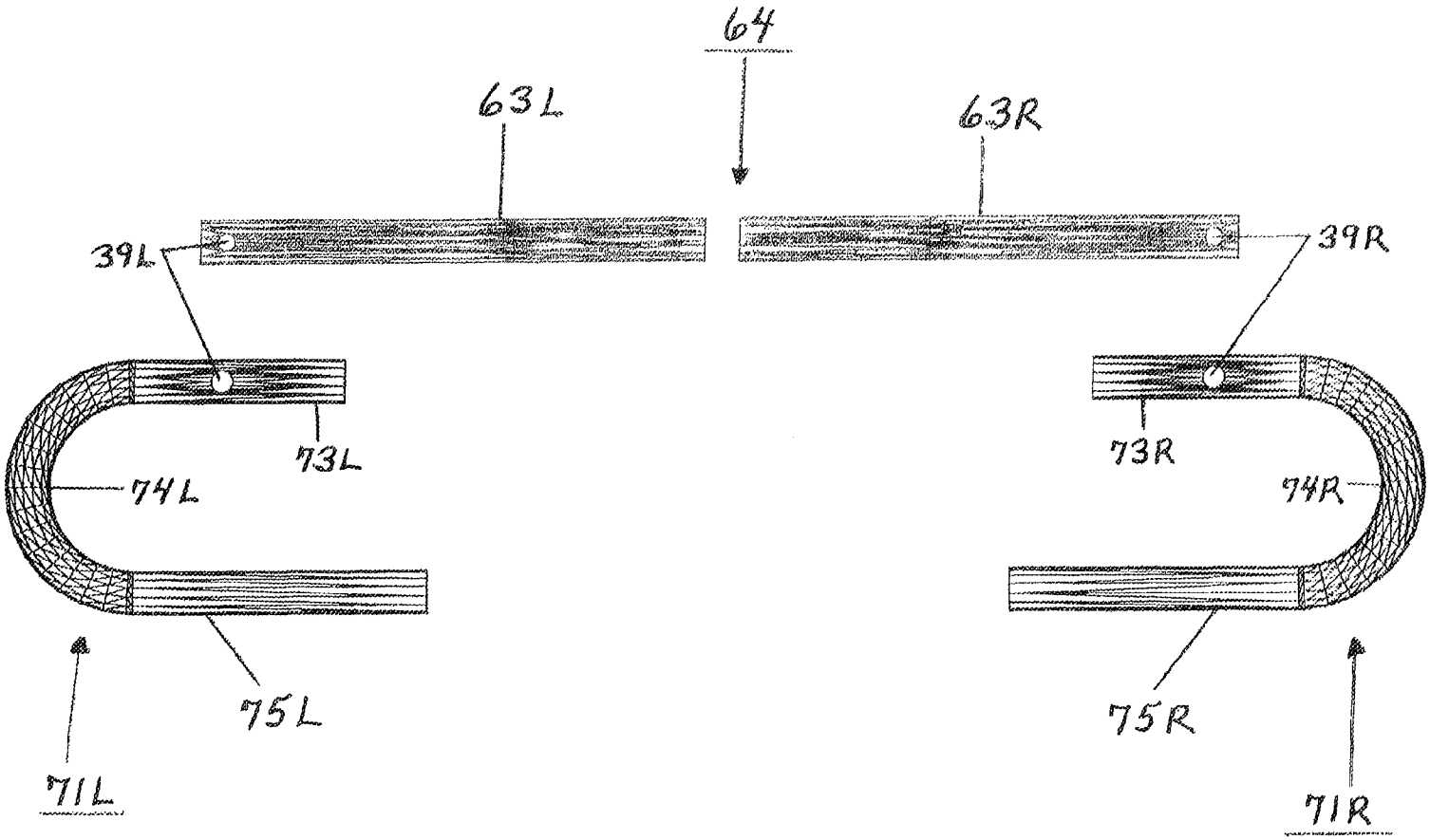

FIG. 9A is a top view of Type 1 component rods that combine dual-drapery rod components with the preferred single-drapery rod of FIG. 5.

Figure 9B:
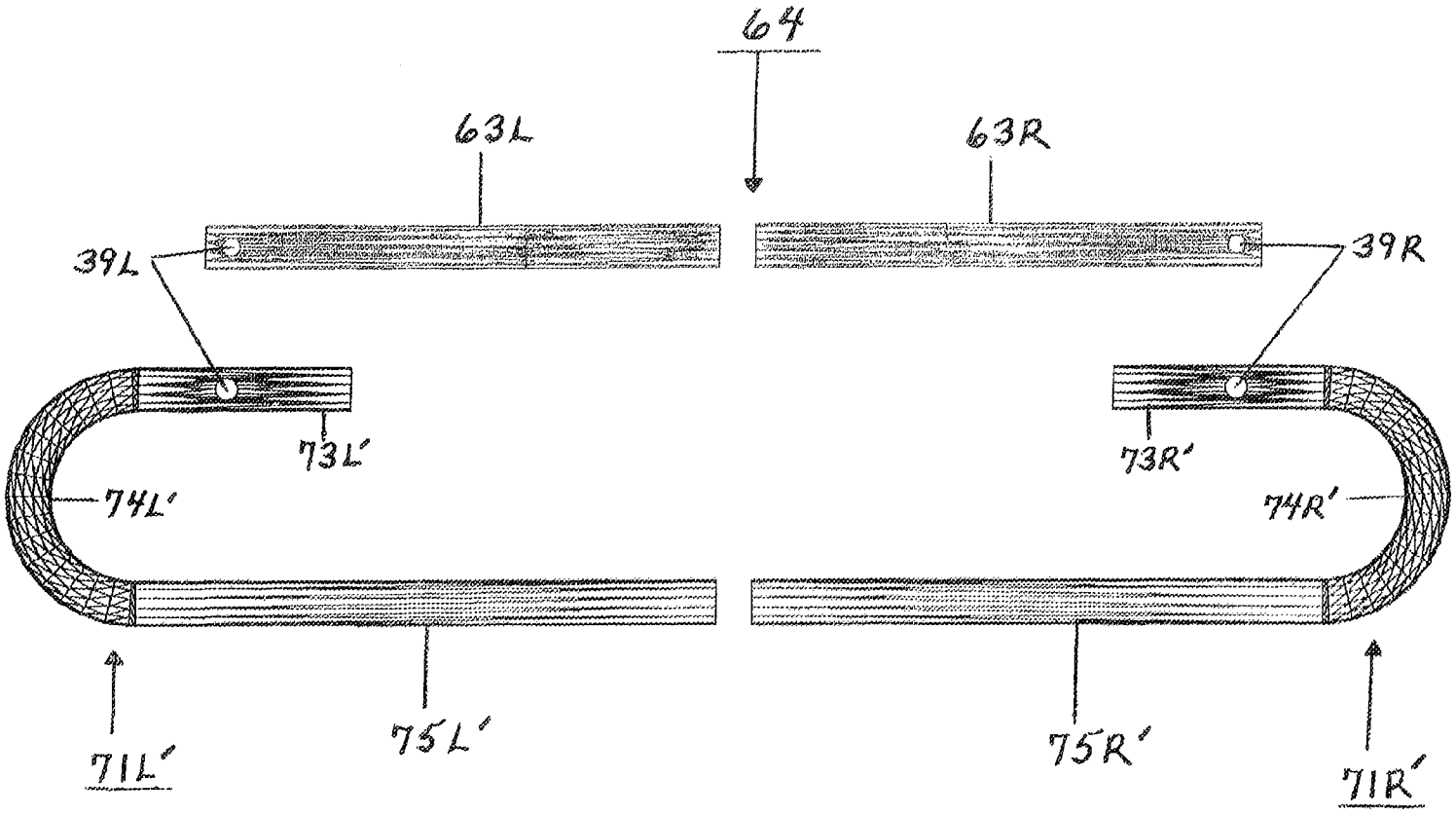

FIG. 9B is a top view of Type 2 component rods that combine dual-drapery rod components with the preferred single-drapery rod of FIG. 5.

Figure 10A:
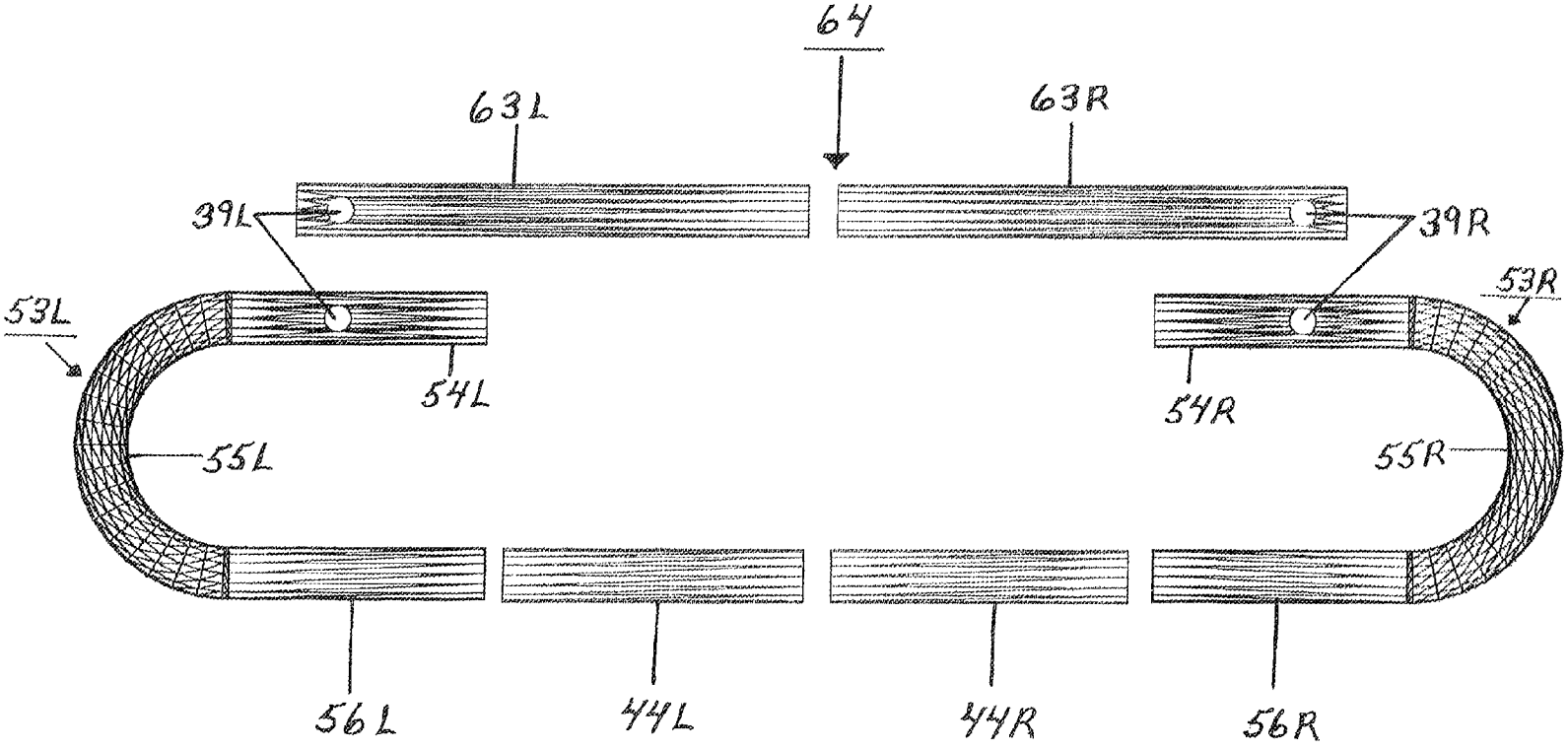

FIG. 10A is a top view of Type 1 component rods that combine the preferred single-drapery rod of FIG. 5 with dual-drapery rod components similar or identical to those shown in FIG. 3A.

Figure 10B:
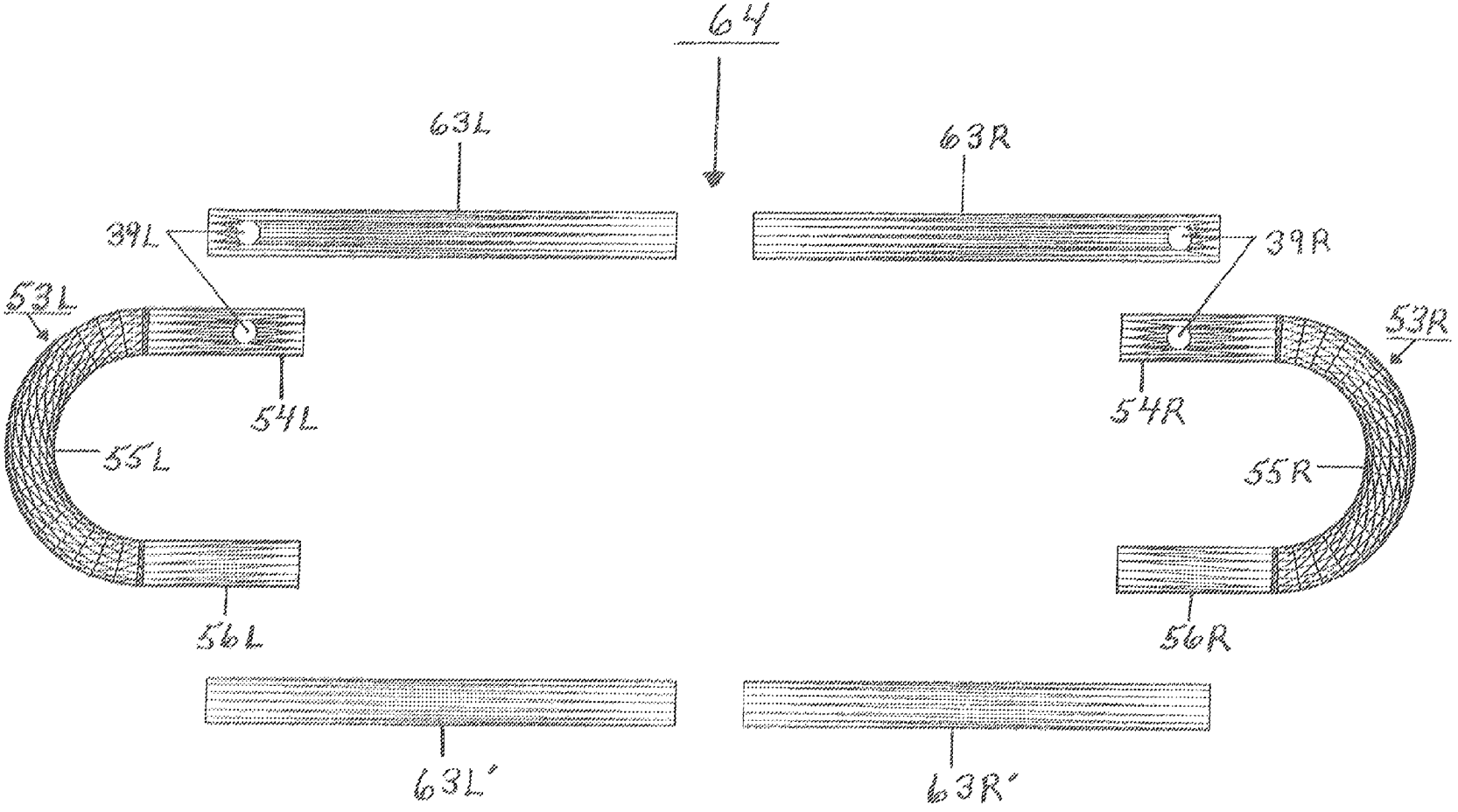

FIG. 10B is a top view of Type 2 component rods that combine the preferred single-drapery rod of FIG. 5 with dual-drapery rod components similar or identical to those shown in FIG. 3B.

Figure 11A:
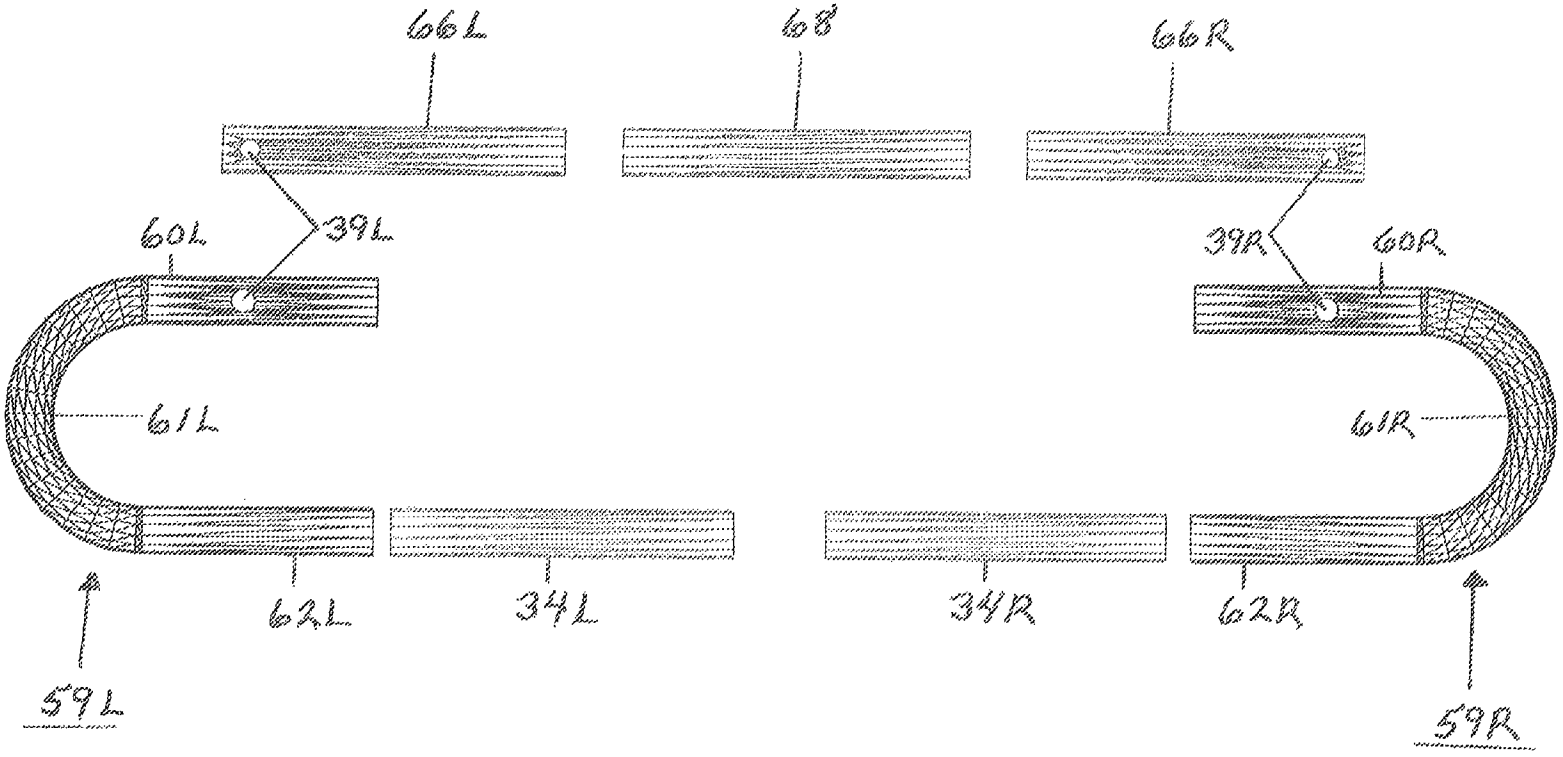

FIG. 11A is a top view of Type 1 component rods that combine the single-drapery rod of FIG. 6 with dual-drapery rod components similar or identical to those shown in FIG. 4A.

Figure 11B:
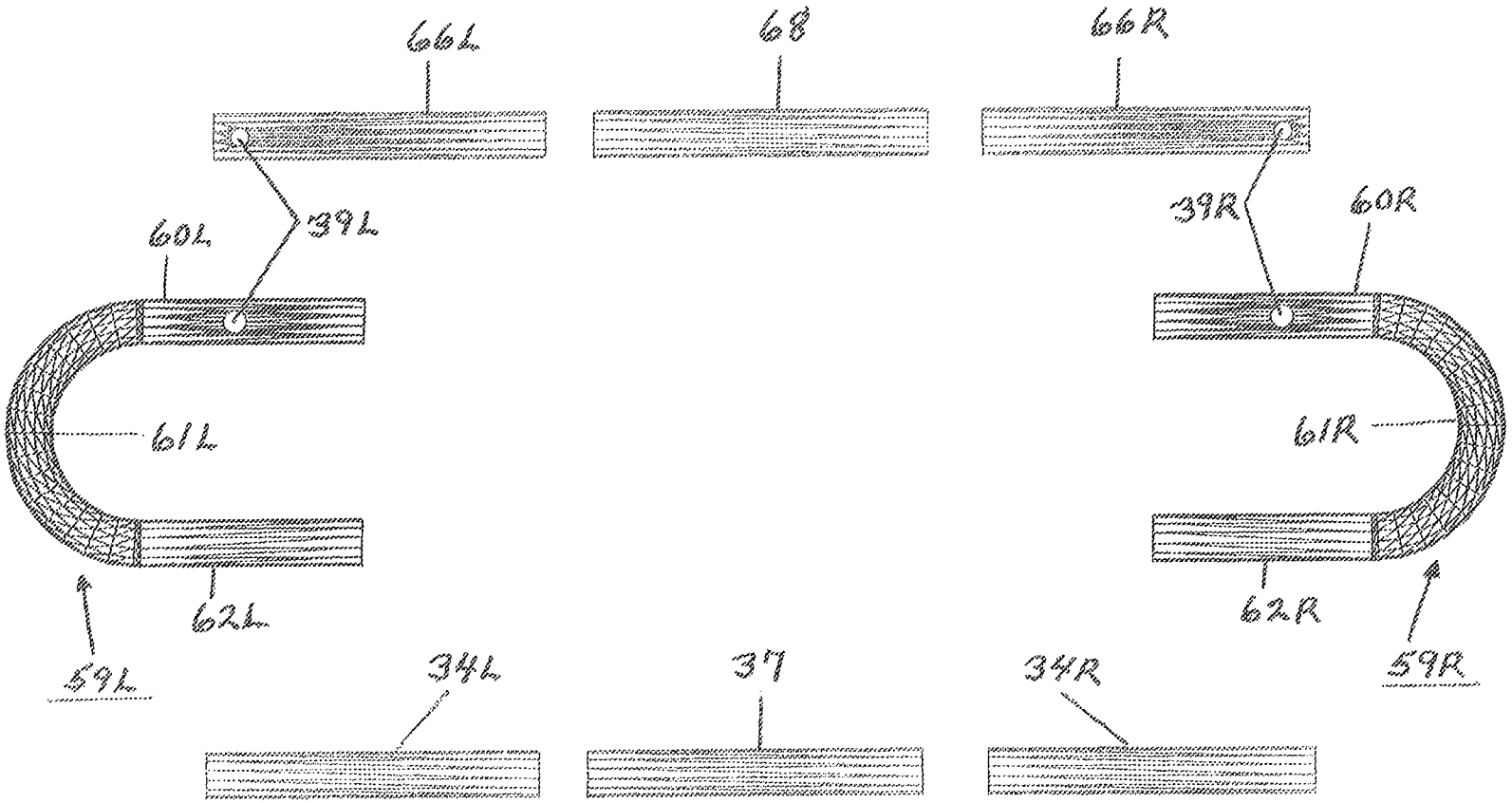

FIG. 11B is a top view of Type 2 component rods that combine the single-drapery rod of FIG. 6 with dual-drapery rod components similar or identical to those shown in FIG. 4B.

Figure 12A:
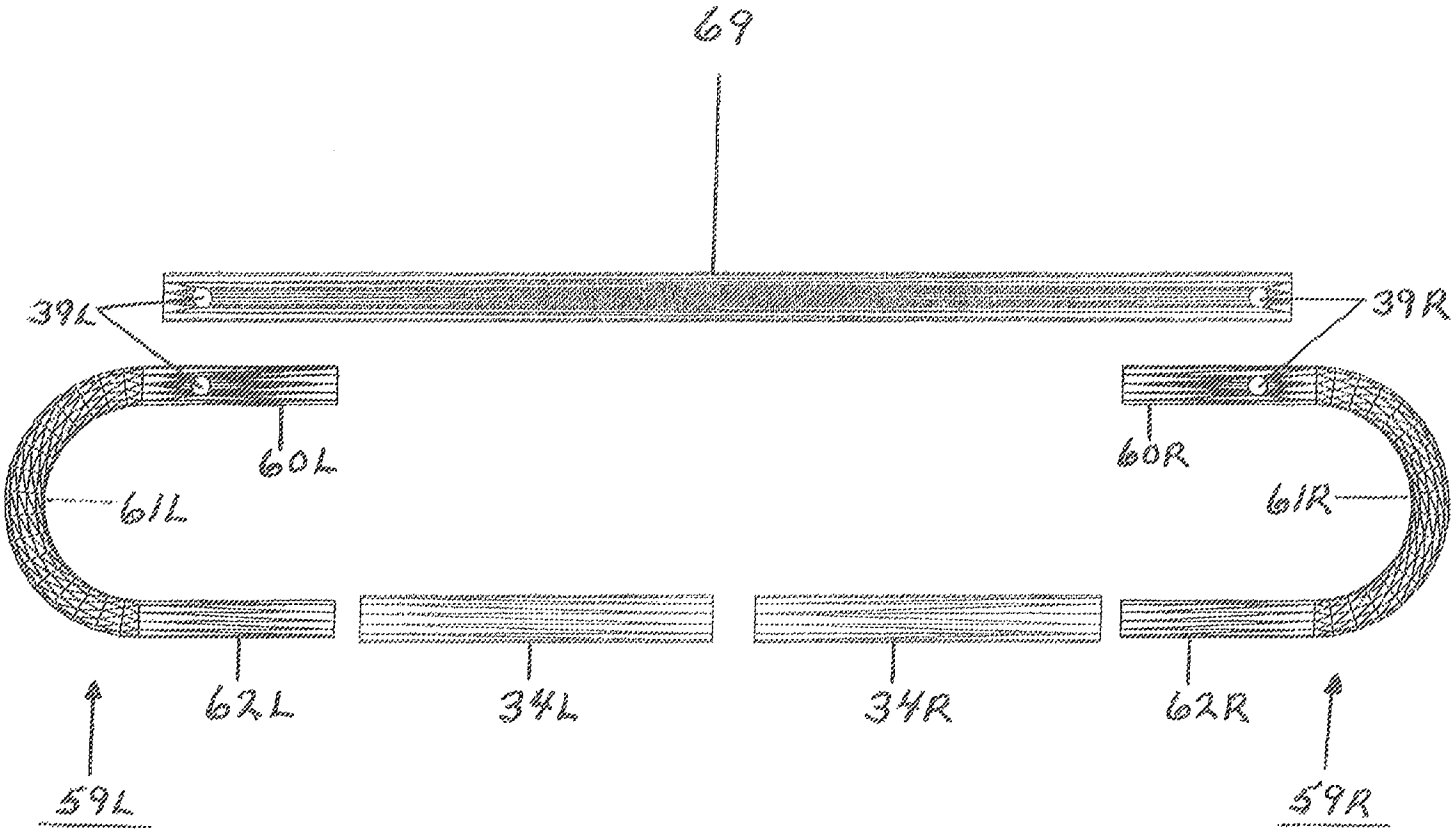

FIG. 12A is a top view of Type 1 component rods that combine the single-drapery rod of FIG. 7 with dual-drapery rod components similar or identical to those shown in FIG. 4A.

Figure 12B:
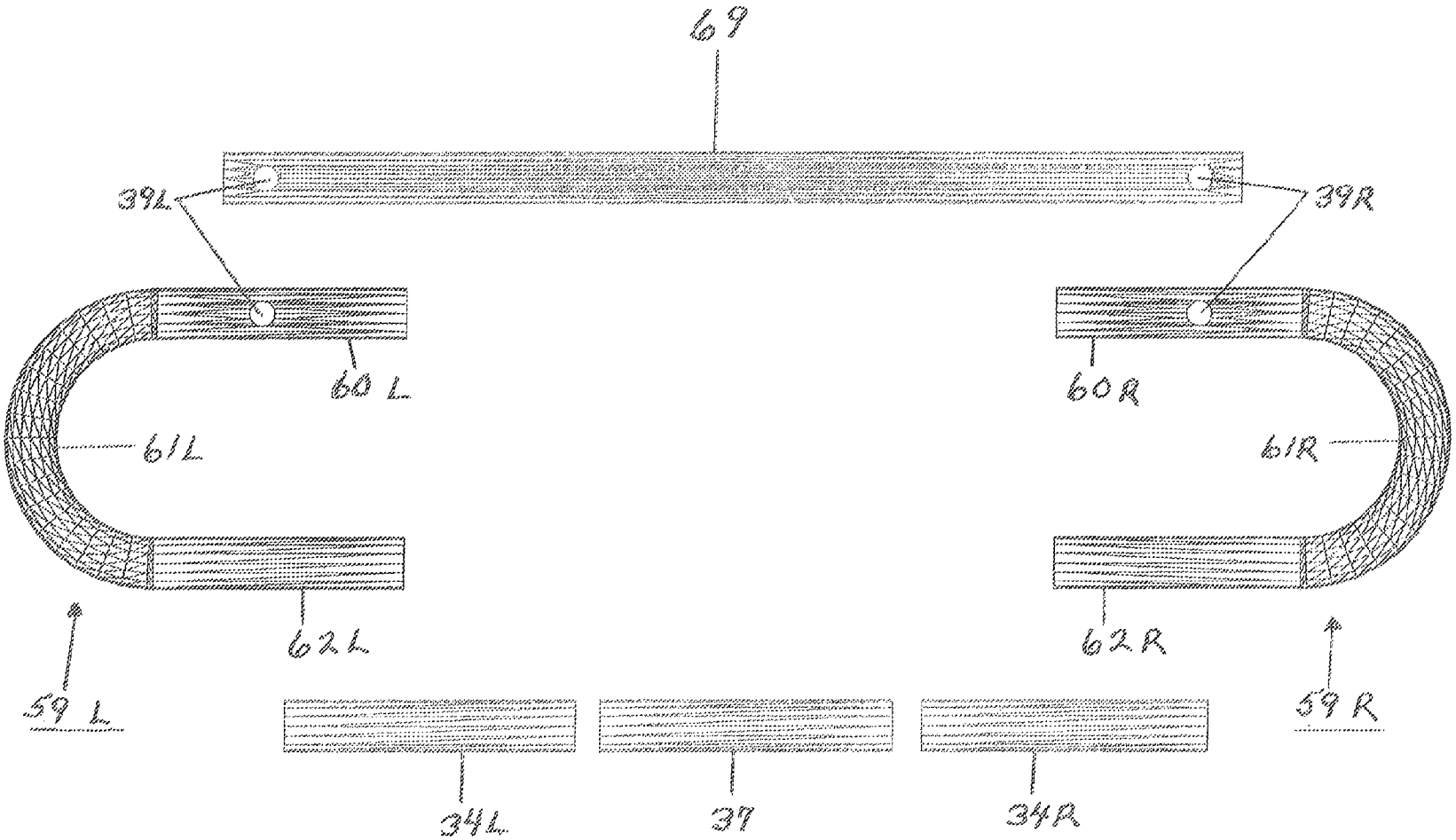

FIG. 12B is a top view of Type 2 component rods that combine the single-drapery rod of FIG. 7 with dual-drapery rod components similar or identical to those shown in FIG. 4B.

Figure 13:
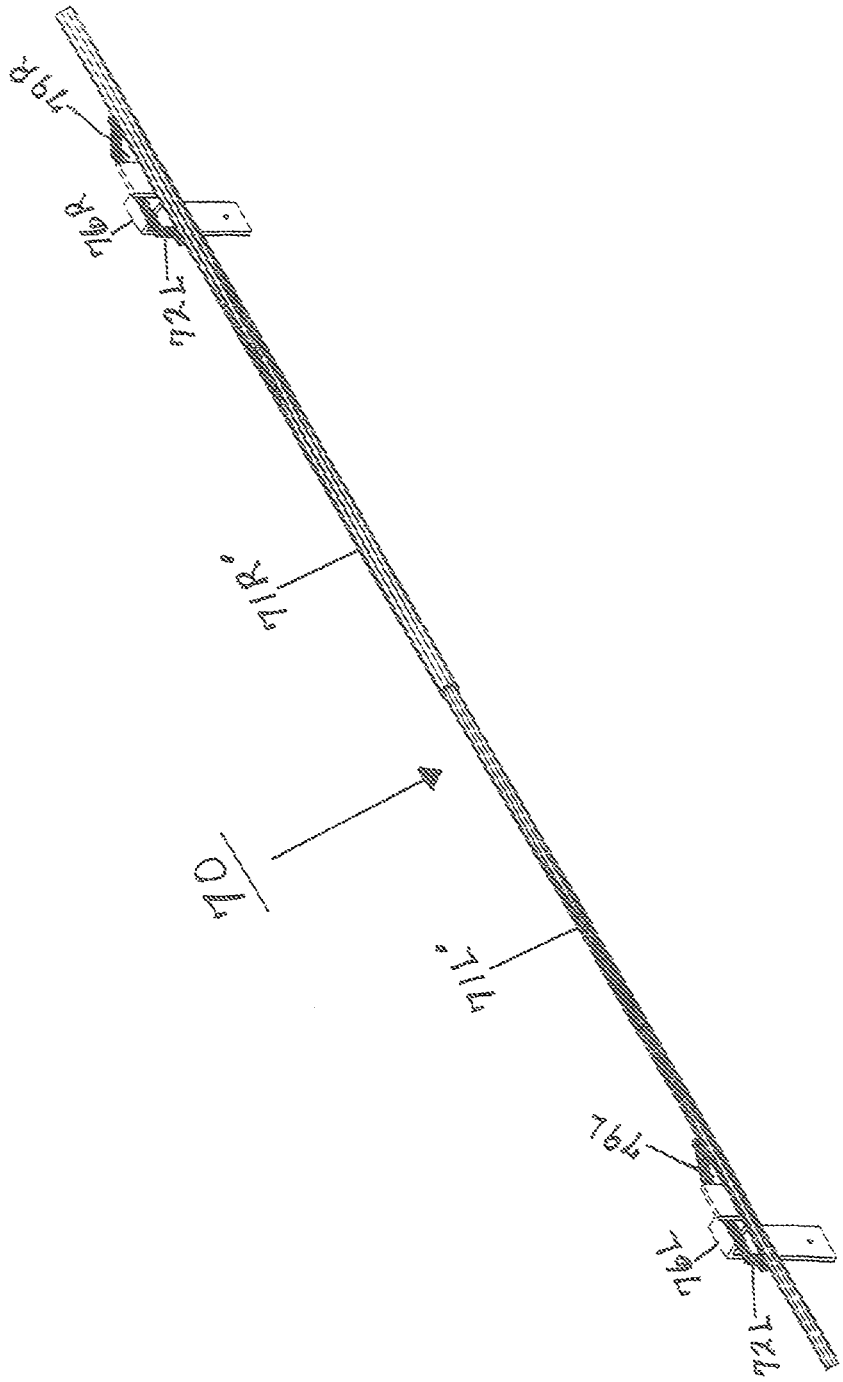

FIG. 13 shows the preferred embodiment of the single-drapery rod with non-slip brackets.

Figure 14A:
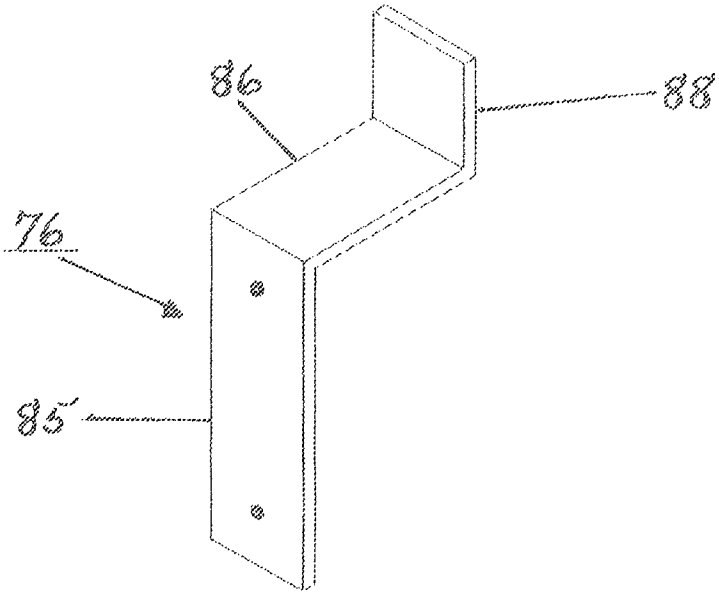

FIG. 14A is a perspective view of the non-adjustable wall mounting bracket that cooperates with non-slip brackets.

Figure 14B:
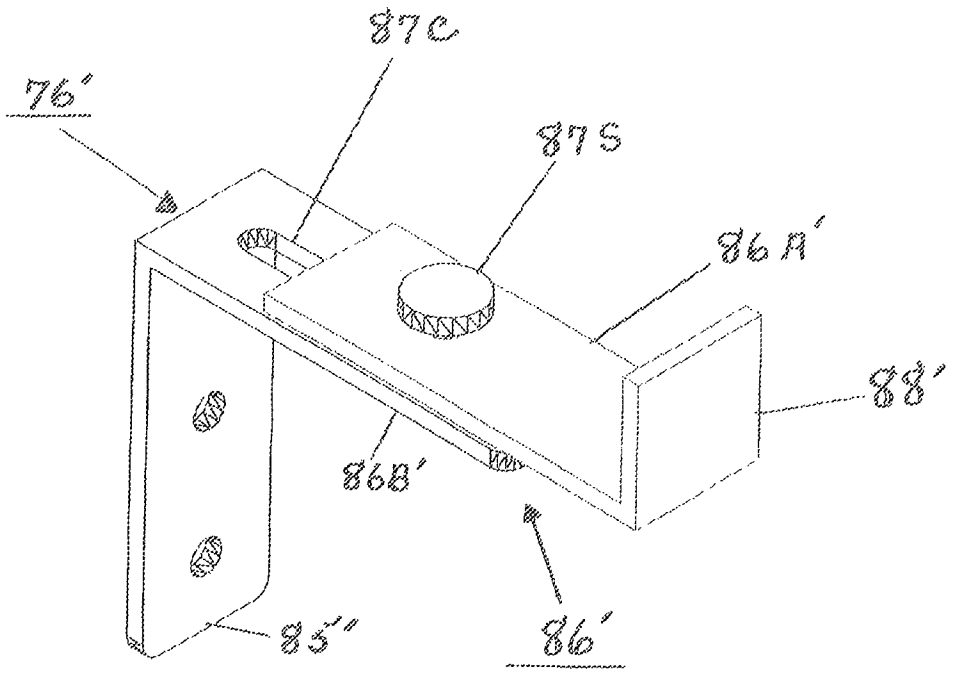

FIG. 14B is a perspective view of the adjustable bracket.

Figure 15:
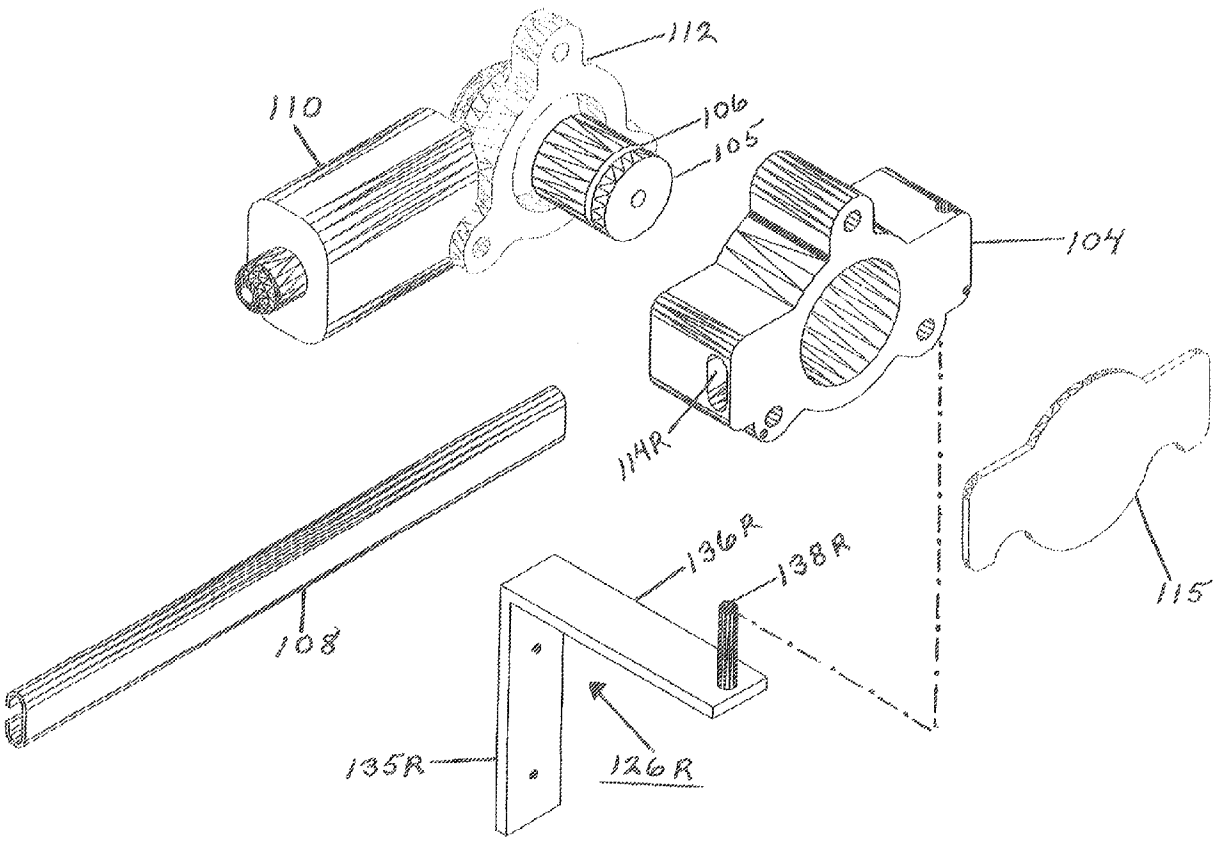

FIG. 15 is a perspective front view of the components of a right-engaging motorized single-drapery rod conversion assembly with a partial view of a cooperating traverse rod.

Figure 16:
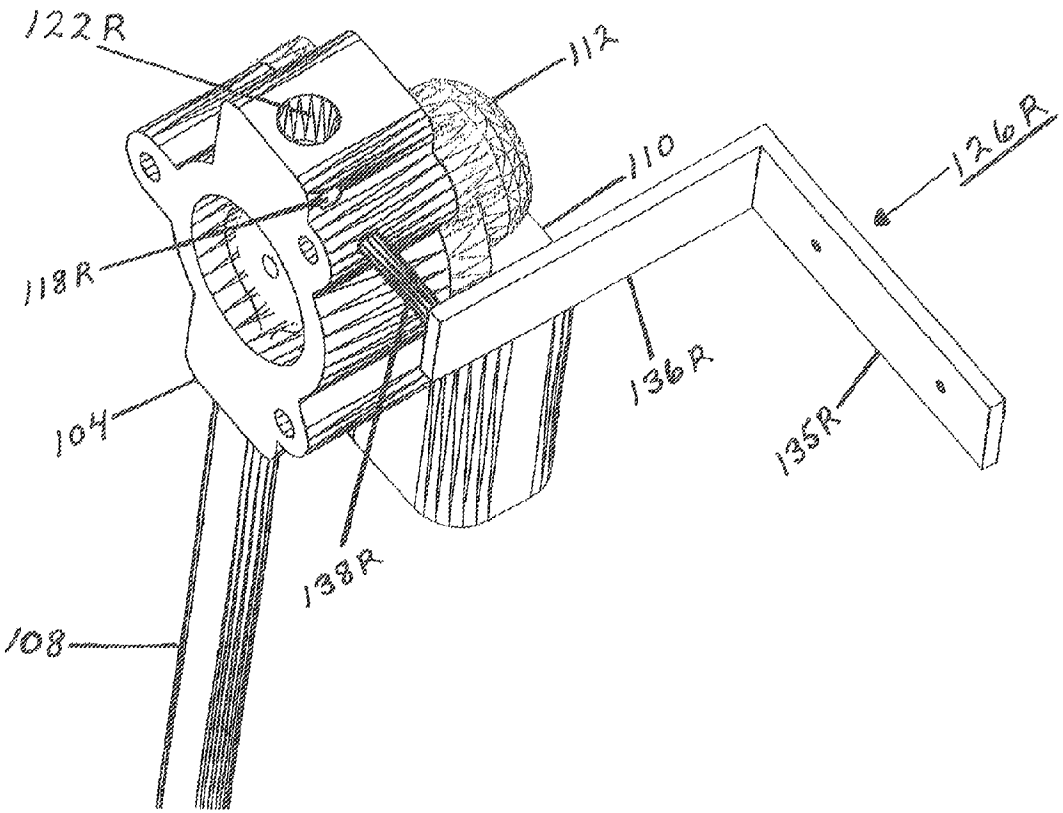

FIG. 16 is a perspective view from below and behind the drive pulley housing of FIG. 15.

Figure 17:
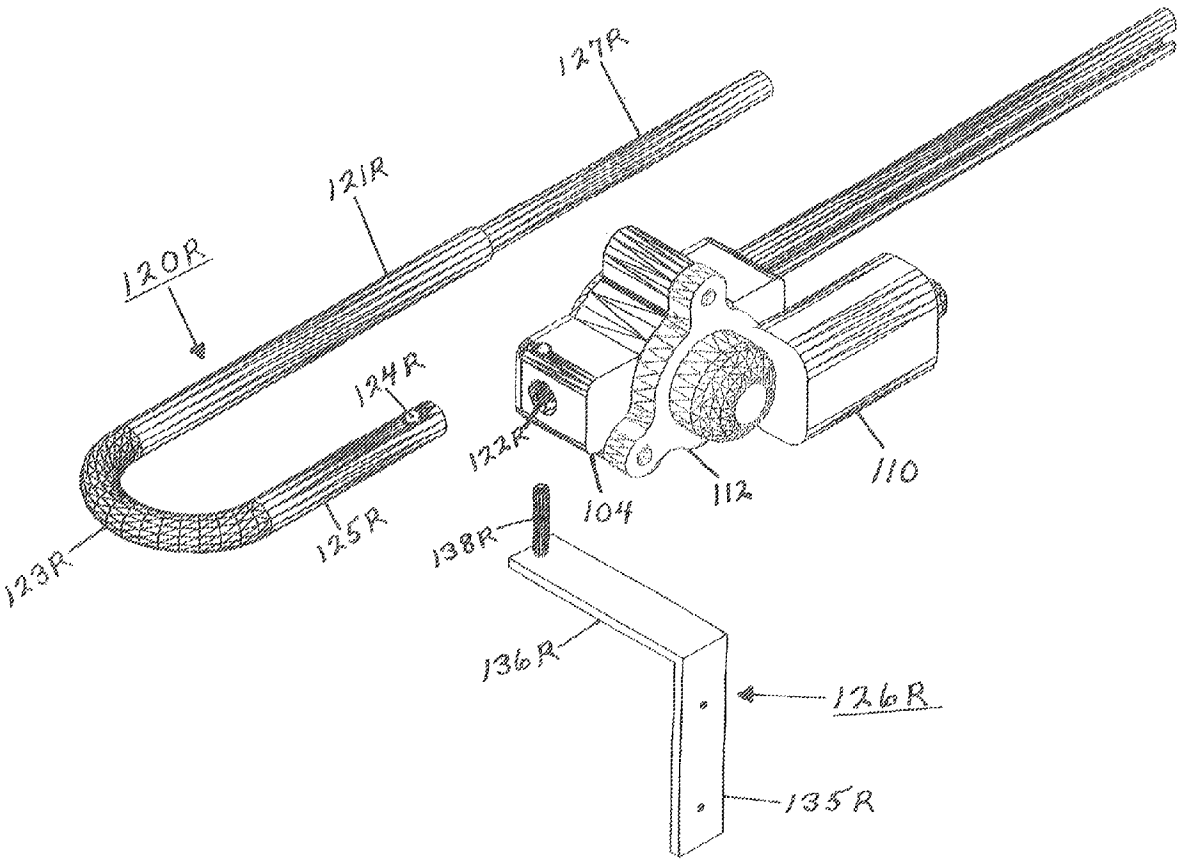

FIG. 17 is a back perspective partial view of a motorized dual-drapery rod conversion assembly with cooperating traverse rod and right dual-drapery rod.

Figure 18:
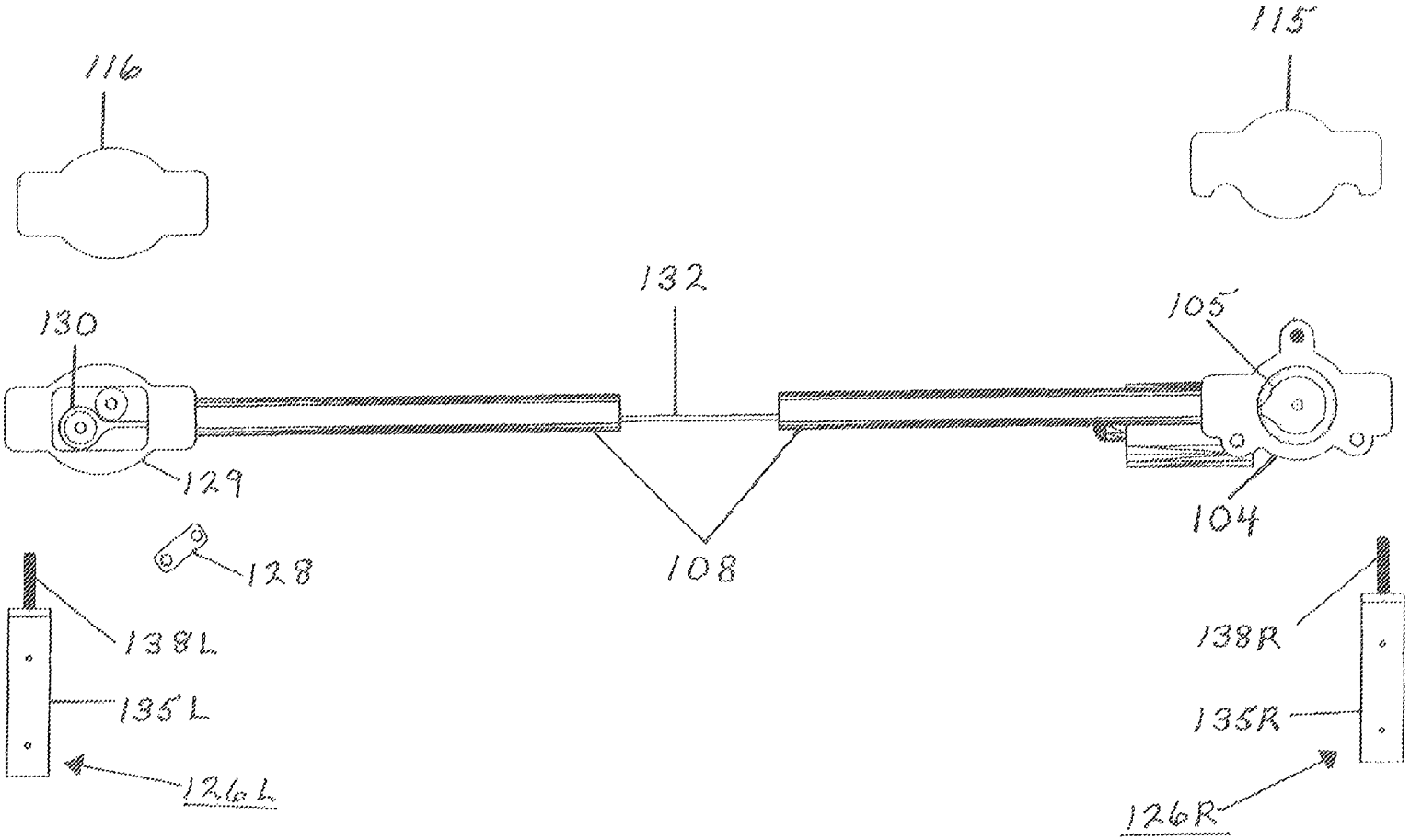

FIG. 18 provides a front view of take-up and drive pulley housings with key components and a traverse rod between them.

Figure 19:
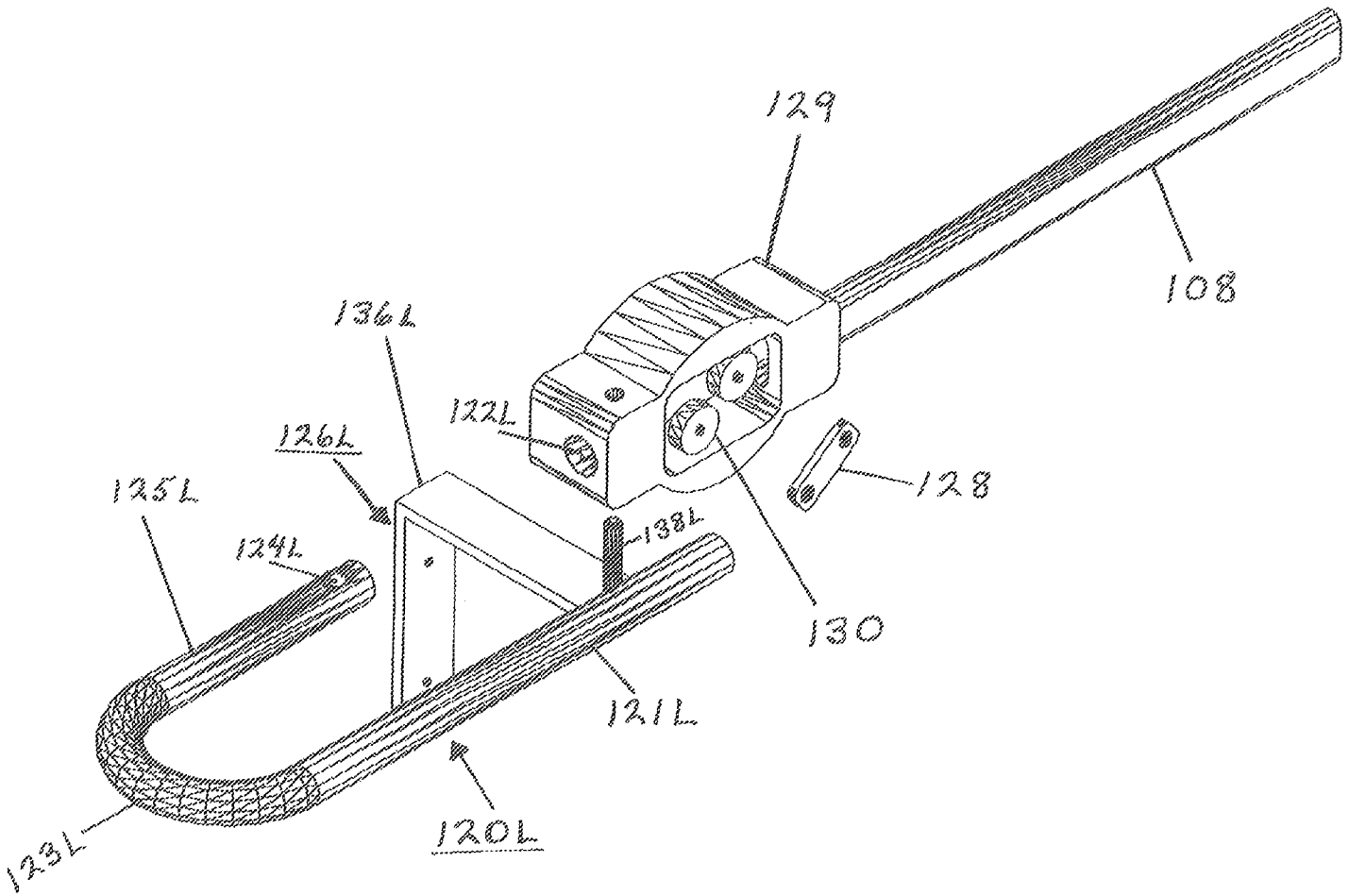

FIG. 19 is a front perspective partial view of the take-up pulley housing attached to a traverse rod along with a view of a separated dual-drapery rod and mounting bracket.

Figure 20:
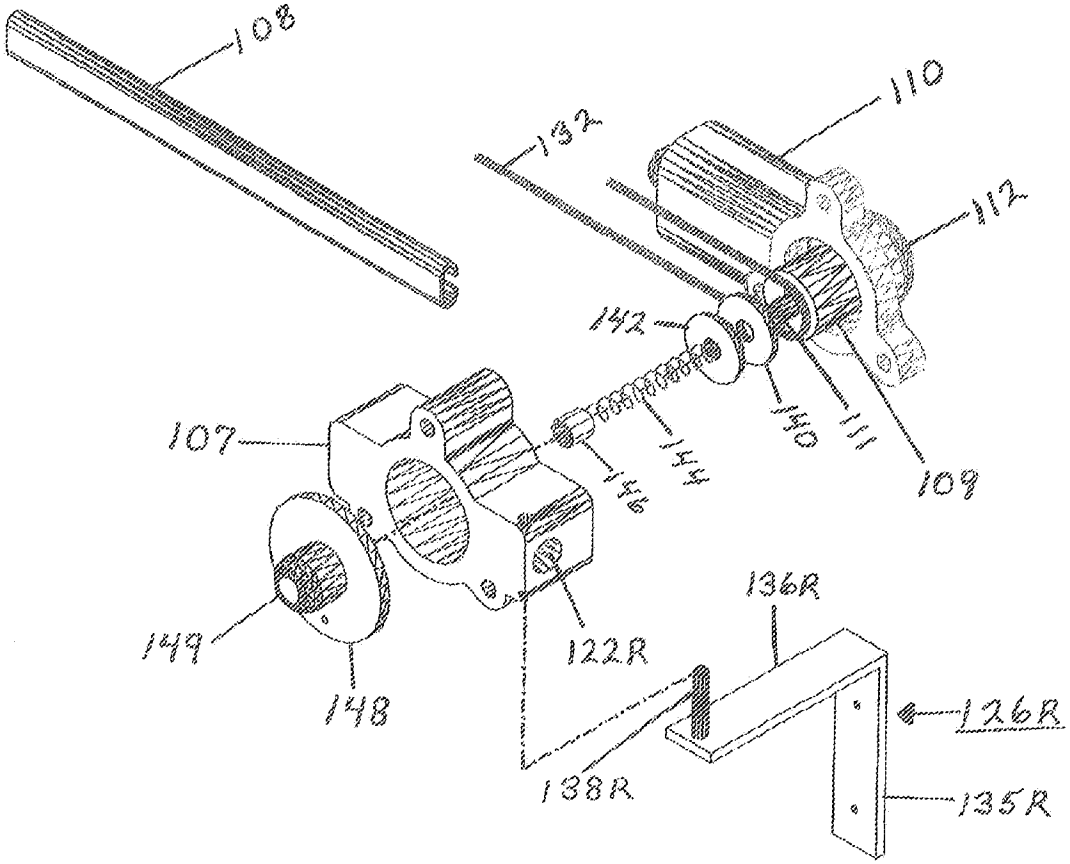

FIG. 20 is a perspective front view of a second embodiment of the drive pulley apparatus along with other key components of the conversion assembly and a partial view of a cooperating traverse rod.

DETAILED DESCRIPTION OF INVENTION

Those of ordinary skill in the art will realize that the following detailed description of the present invention is illustrative only and not intended to be in any way limiting. Other embodiments not shown here will readily suggest themselves to such skilled persons having the benefit of this disclosure. Only two adjustable and two non-adjustable mounting brackets are shown, but similar ones will suggest themselves to those familiar with the art, and some will be described although they are not shown. Other types of brackets could also be used, but they would require substantial modification of the rod itself and would not retain the advantages of the preferred brackets. Additional configurations of component rods are also possible, although a number are shown here that have specified advantages. Component rods could also be inter-engaged by connectors and clamps of various types rather than telescopically, but telescopic engagement allows major adjustment in the span of the rod.

Reference will now be made to implementations of the present invention as illustrated in the embodiments shown in the accompanying drawings. In the interest of brevity and clarity, the drawings focus on the non-routine features of the invention and therefore do not show many routine features well known to those skilled in the art. Not shown or detailed, for example, are any of number of means well known in the industry for securing mounting brackets to support surfaces, providing center support for rods, using set screws, finishing the edges of telescopically inter-engaged rods, and using structural ribs, ridges, and the like to increase the strength of components.

Figure 1B:
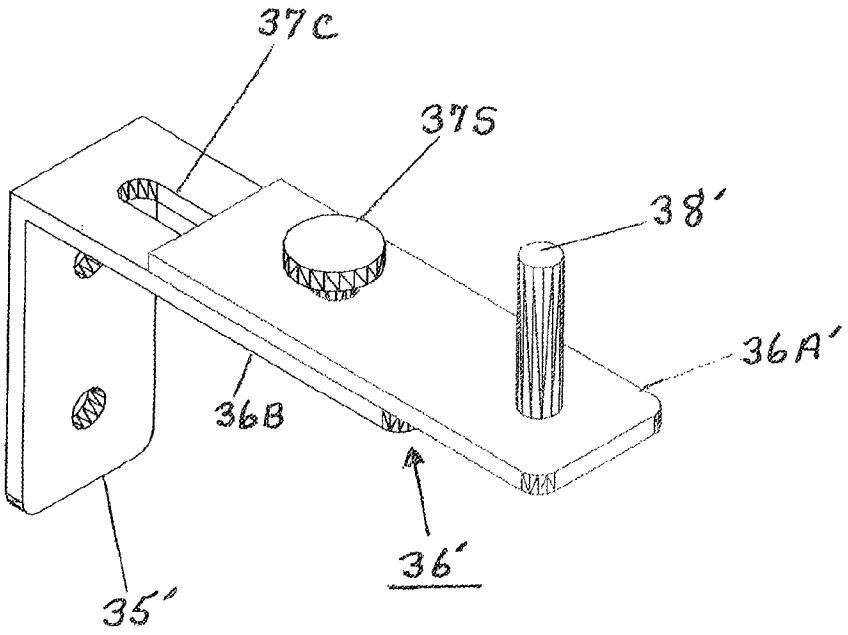
FIG. 1B is a perspective view from above of the preferred adjustable wall mounting bracket.

The non-adjustable and adjustable versions of the preferred wall mounting bracket are detailed in FIGS. 1A and 1B. FIGS. 2-4 show embodiments comprised of different configurations of telescopically inter-engaging component rods which assemble into Type 1 or 2 dual-drapery rod embodiments. All are designed to use the preferred wall mounting bracket of FIG. 1A or 1B. The bracket can also be used to mount embodiments onto ceilings, but some adjustment is needed in the bracket or the rods in order to mount the dual-drapery rod to a ceiling. Although not shown, the needed adjustments will be discussed.

FIG. 1A is a perspective view from above of the preferred non-adjustable wall mounting bracket. The wall mounting bracket includes a first member comprised of a base plate 35 with a vertically elongated body, a second member 36 with a horizontally elongated body extending substantially perpendicularly from 35, and a third member 38 with a vertically elongated cylindrical body extending upwardly and substantially perpendicularly from 36. Members 35 and 36 can be formed from a single elongated plate made of metal or a similarly strong material that is bent approximately 90 degrees, or two such plates can be attached by welding, brazing, or fusing them together. Third member 38 cannot be simply an angled extension of the second member since the two are shaped very differently. It is attached to 36 by some method such as welding, brazing, or fusion.

The first and second members of the wall mounting bracket are familiar from prior art. The third member's structure and operation are not. Base plate 35 has screw holes 35S penetrating it, and a surface adapted to engage and attach to a vertical support structure using screws, wall anchors, or other similar attachment means (not shown) while second member 36 engages the bottom surface of the drapery rod. Third member 38 is sized and shaped to fit into circular apertures penetrating the rod's top and bottom surfaces at an angle substantially perpendicular to the plane of the intermediate sections of the rod, engaging the surrounding surfaces of the apertures. An advantage to using cylindrical third members is that their surrounding surfaces can be strengthened by the insertion of easily manufactured tubular reinforcements (not shown) into the apertures of what are frequently hollow telescoping rods. The fact that cylindrical third members can rotate within the apertures also has distinct advantages when used with single-drapery rods, those advantages to be identified when describing the mounting of single-drapery rods in connection with FIGS. 5-8.

FIG. 1B is a perspective view from above of the preferred adjustable wall mounting bracket. The base plate and third member are as described with the non-adjustable bracket. The adjustable second member 36' is similar to horizontally adjusting members shown for some time in prior art (e.g., U.S. Pat. No. 4,120,474). It is comprised of lower member 36B' and sliding upper member 36A'. Longitudinally extending channel or slot 37C in 36B' cooperates with an adjustment screw (not shown) operated with an attached head 37S to adjust 36' for desired clearance from the support surface without the need for tools. 37S is turned to loosen the screw and allow 36A' to be extended or retracted along 37C, with the range of motion being determined by the length of 37C. 37S is turned to tighten the screw at the appropriate point for desired clearance from the support structure.

The preferred wall mounting brackets of FIGS. 1A and 1B can also be adapted to adjust vertically by using vertically elongated channels or slots rather than screw holes on the base plate. Although useful, they are well known in prior art and therefore not shown. The focus in these drawings is on the non-routine features of the multi-purpose drapery rod assembly. However, it should be recognized that the addition of such a vertical adjustment mechanism is within the scope of the present invention.

The preferred wall mounting brackets of FIGS. 1A and 1B can be used to mount a dual-drapery rod to a wall or ceiling, but the cooperating apertures in the latter case would have to penetrate through the rod horizontally rather than perpendicularly since third member 38 would extend horizontally in a ceiling mount. A collar or pin at the end of 38 would be advisable in that case to keep the rod from slipping off of 38. Alternatively, the bracket could be modified to create a ceiling mount with a third member extending downward rather than horizontally from the second member. This would require the use of a collar or pin at the end of 38 to secure the rod, but would then not require a change in the disposition of the cooperating apertures on the dual-drapery rod.

FIGS. 2A, 2B, and 3A-4B show dual-drapery rod embodiments having different configurations of telescopically inter-engaging component rods made of rigid material with top and bottom surfaces. Component rods are inter-engaged telescopically so that the span of the dual-drapery rod can be easily adjusted, but other inter-engaging methods employing various kinds of connectors or clamps or even using methods such as welding, brazing, or fusion are possible.

All of the configurations of component rods shown in FIGS. 2A, 2B, and 3A-4B include two rods with segments that curve approximately 180 degrees. All are also designed to be used with the preferred wall mounting bracket and therefore have circular apertures penetrating the top and bottom surfaces of the appropriate component rod(s) at a substantially perpendicular angle. As previously noted, when mounted on a ceiling, the apertures would have to be horizontally rather than perpendicularly disposed to cooperate with the preferred mounting bracket. Alternatively, the bracket could be modified to extend the third member downward rather than horizontally so that the disposition of the apertures did not have to be changed.

FIGS. 2A, 3A, and 4A display embodiments comprised of component rods that telescopically inter-engage with a single-drapery rod to form a Type 1 dual-drapery rod. FIGS. 2B, 3B, and 4B display embodiments of component rods that telescopically inter-engage with a single-drapery rod to form a Type 2 dual-drapery rod. Since all of the embodiments incorporate a single-drapery rod, the other component rods can be used in converting telescopically engageable single-drapery rods currently available on the market into dual-drapery rods.

FIG. 2A is a top view of the preferred configuration of component rods that assemble into a Type 1 dual-drapery rod designed to layer accent drapery in front and to the side of primary drapery. This configuration is the preferred embodiment for two reasons. First, the component rods can be assembled into a Type 2 dual-drapery rod with the simple addition of one more component rod. Second, back center rod 29 can be any compatible unitary single-drapery rod, of which there are many available and in use. Single-drapery rods are also included in the second and third Type 1 and Type 2 embodiments shown in FIGS. 3A-4B. However, those single-drapery rods are less common and are themselves comprised of two or more components.

Component rods of the preferred embodiment shown in FIG. 2A include substantially straight back center rod 29 and left and right front rods 34L and 34R as well as left and right curved rods 30L and 30R. Back center rod 29 may be an existing engageable single-drapery rod or a new one provided with the other component rods. Circular apertures 39L and 39R penetrate rods 30L and 30R and are sized to receive the third member of the preferred wall mounting bracket. 30L and 30R are comprised of curved segments 31L and 31R sandwiched between substantially straight back segments 32L and 32R and front segments 33L and 33R. Back segments 32L and 32R are substantially longer than front segments 33L and 33R. Curved segments 31L and 31R are curved toward each other approximately 180 degrees over a predetermined distance, thereby positioning back segments 32L and 32R in a substantially straight line substantially parallel to and at a desired distance from 33L and 33R.

Apertures 39L and 39R penetrate the top and bottom surfaces of 32L and 32R at points substantially adjacent to 31L and 31R and at an angle substantially perpendicular to the planes of curved rods 30L and 30R to create two sets of rigid circular surfaces vertically disposed from each other in substantially perpendicular fashion. Tubular reinforcements (not shown) can be inserted through the apertures to strengthen the surrounding surfaces when needed.

The dual-drapery rod is assembled by telescopically inter-engaging 29 with 32L and 32R without covering apertures 39L and 39R, and telescopically inter-engaging 33L and 33R with 34L and 34R while keeping 30L in the same plane as 30R. The back section of the rod is therefore formed by rod 29 and back sections 32L and 32R, the intermediate section by curved segments 31L and 31R, and the front sections of the dual-drapery rod by left and right front rods 34L and 34R along with left and right front segments 33L and 33R.

FIG. 2AA is a perspective view from above of the component rods shown in FIG. 2A telescoped together and mounted on a (not shown) wall or other substantially vertical support surface using the preferred non-adjustable bracket of FIG. 1A. Although the back center rod can be an existing engageable single-drapery rod or a new one provided with the other component rods, back center rod 29 is assumed to be an existing rod in FIG. 2AA and is accordingly differentiated from the other component rods. The rods are assembled together by telescopically engaging curved rods 30L and 30R with back center rod 29 and with front rods 34L and 34R while keeping the curved rods in the same plane. More specifically, 29 is engaged with 32L and 32R; and 34L and 34R are engaged with 33L and 33R. Wall mounting brackets 26L and 26R, shown in detail in FIG. 1A, attach to a wall or other substantially vertical support surface with anchoring bolts or other common attachment means (not shown). The brackets attach to 30L and 30R at points substantially adjacent to 31L and 31R by engaging the bottom of 32L and 34R and the inside surfaces of the apertures shown in FIG. 2A, thereby securing the rod in a substantially horizontal plane. Finials 28 are attached to the left end of 34L and right end of 34R. Primary drapery (not shown) is supported by that portion of the assembled components between 26L and 26R. Secondary accent drapery (also not shown) is supported by the remainder of the assembled dual-drapery rod.

FIG. 2B is a top view of the preferred configuration of component rods that assemble into a Type 2 dual-drapery rod to layer primary drapery in front and to the side of secondary drapery. Component rods include front center rod 37 plus the component rods shown in FIG. 2A. The Type 1 embodiment of FIG. 2A is converted into the Type 2 embodiment of FIG. 2B by telescopically inter-engaging 37 between 34L and 34R so that the left and right front sections of the dual-drapery rod inter-engage to form a continuous front section capable of supporting fully drawn primary drapery.

FIG. 3A is a top view of the primary components of the second Type 1 embodiment that includes a single-drapery rod. This embodiment includes more drapery rod components than the preferred embodiment and requires the replacement of two rods rather than a simple addition of one when converting to a Type 2 embodiment, but the span of the rod is still adjustable.

The embodiment shown in FIG. 3A includes a binary single-drapery rod comprised of substantially straight back center rods 52L and 52R; substantially straight left and right front rods 44L and 44R; and curved rods 53L and 53R comprised of curved segments 55L and 55R sandwiched between substantially straight back segments 54L and 54R and front segments 56L and 56R. Apertures 39L and 39R penetrate perpendicularly through the top and bottom surfaces of 53L and 53R at points substantially adjacent to 55L and 55R. The drapery rod is assembled by telescopically inter-engaging 52L and 52R with each other and with 54L and 54R of rods 53L and 53R without covering apertures 39L and 39R, and telescopically engaging 44L and 44R with 56L and 56R while keeping rods 53L and 53R in substantially the same plane. The back section of the rod is therefore formed by 54L, 52L, 52R, and 54R; the intermediate section by 55L and 55R; the left front section by 44L and 56L, and the right front section by 44R and 56R.

FIG. 3B is a top view of the component rods of the second Type 2 embodiment that includes a single-drapery rod. This Type 2 embodiment, like the Type 1 embodiment shown in FIG. 3A, includes rods 52L, 52R, 53L and 53R. However, front left and right rods 44L and 44R are replaced with front center rods 52L' and 52R'. 52L' and 52R' have substantially the same dimensions as 52L and 52R, but the former are telescopically engaged with 56L and 56R while the latter are, as before, telescopically engaged with 54L and 54R without covering apertures 39L and 39R. The back section and intermediate sections are formed as before with the embodiment of FIG. 3A, but left and right front sections formed by 56L and 52L' and by 56R and 52R' telescopically inter-engage to form a continuous front section capable of supporting fully drawn primary drapery.

FIG. 4A is a top view of the component rods of a third Type 1 embodiment that includes a single-drapery rod. This single-drapery rod is comprised of three telescopically inter-engaging rods. While not as common as the binary or unitary single-drapery rod, the three-piece rod is less reliant on center-support brackets and the strength of each component rod. It may therefore be preferred when heavy drapes must be supported over wide expanses. Additional component rods include back center rod 37', front rods 34L and 34R, and curved rods 59L and 59R comprised of left and right curved segments 61L and 61R sandwiched between substantially straight back segments 60L and 60R and front segments 62L and 62R. Back center rod 37' is telescopically inter-engaged with left and right back rods 34L' and 34R' and 34L' and 34R' are telescopically engaged with 60L and 60R without covering apertures 39L and 39R while keeping curved rods 59L and 59R in the same plane. Left and right front rods 34L and 34R (equivalent to those in the embodiment of FIG. 2A assuming the single-drapery rods of that embodiment and this one are telescopically compatible) are telescopically engaged with 62L and 62R. 34L', 37', 34R', 60L, and 60R form the back section of the dual-drapery rod; curved sections 61L and 61R form the intermediate section; 62L and 34L form the left front section; and 62R and 34R form the right front section. Rods 34L' and 34R' are identical to 34L and 34R except in their placement. This Type 1 embodiment, like the one shown in FIG. 2A, is easily converted to a Type 2 embodiment with the simple addition of a front center rod as shown in FIG. 4B.

FIG. 4B is a top view of the component rods of the third Type 2 embodiment that includes a single-drapery rod. Components include front center rod 37 plus the components of the Type 1 rod shown in FIG. 4A. 37 is telescopically inter-engaged between 34L and 34R to form a continuous front section that can support fully drawn primary drapery.

FIGS. 5-8 show single-drapery rods mounted with the preferred non-adjustable mounting bracket of FIG. 1A onto opposing vertical support surfaces like that found surrounding recessed windows. This contrasts with previous figures which show or assume wall-mounting. Since the cylindrical shape of the third member allows it to rotate 360 degrees within the perpendicularly disposed receiving aperture, the base plate of the bracket can actually be attached to vertical support surfaces lying at nearly any angle from the single-drapery rod as long as the third member is further from the base plate than from the end of the rod at that angle. The brackets shown in FIGS. 1A and 1B could also be used to attach the single-drapery rods to the ceiling with the simple addition of a collar at the end of the bracket's third member.

FIG. 5 is a side view of the preferred embodiment of the single-drapery rod mounted on opposing vertical support surfaces. Single-drapery rod 64 is comprised of telescopically inter-engaging left and right rods 63L and 63R. Apertures penetrate the rod's top and bottom surfaces in a substantially perpendicular direction at points substantially adjacent to the left end of 63L and right end of 63R. Third members 38L and 38R of mounting brackets 26L and 26R fit through the apertures and engage the surfaces surrounding the apertures while second members 36L and 36R engage the bottom surfaces of 63L and 63R and 35L and 35R engage the opposing support surfaces.

FIG. 6 is a side view of a second embodiment of the single-drapery rod and bracket. This embodiment has more component rods than the first, but is less reliant on center support brackets and the strength of each of the component rods to prevent the rod from sagging under the weight of a wide expanse of drapery. In this embodiment, single-drapery rod 65 is comprised of center rod 68 telescopically inter-engaged between left and right rods 66L and 66R. Third members 38L and 38R engage the surfaces surrounding the apertures penetrating rods 66L and 66R as in FIG. 8 while second members 36L and 36R engage the bottom surfaces of 66L and 66R and base plates 35L and 35R engage the opposing support surfaces.

FIG. 7 is a side view of a single-drapery rod comprised of a single rod 69 rather than a plurality of telescoping rods. Members 35, 36, and 38L and 38R operate as in FIGS. 5-6.

FIG. 8 is perspective view from above and to the right of the preferred embodiment of the single-drapery rod. As in FIGS. 5-7, base plates 35L and 35R are shown as if mounted on a perpendicularly disposed support surface (not shown) like that found surrounding recessed windows. However, 35L and 35R have been mounted at substantially different heights on the opposing support surfaces. This is possible if second members 36L and 36R are sufficiently elongated since cylindrical third members 38L and 38R can rotate within their receiving apertures and rods 63L and 63R can also be rotated. Collars 38C fitting tightly over 38L and 38R are an appropriate means of securing the rod to the brackets when their third members are substantially horizontal as in FIG. 8.

FIGS. 9-12 show embodiments of component rods that assemble into Type 1 or 2 dual drapery rods incorporating one of the single-drapery rods shown in FIGS. 5-7. All are designed to be mounted on a wall with the preferred wall mounting bracket of FIG. 1A or 1B, and of course all include two rods with segments curved approximately 180 degrees over a pre-determined distance and sandwiched between substantially straight segments. FIGS. 9A-12A show Type 1 and FIGS. 9B-12B show Type 2 components combined with one of the single-drapery rods of FIGS. 5-7. All of the embodiments employ perpendicularly disposed circular apertures 39L and 39R penetrating the appropriate component rods in order to match the perpendicularly extending third member of the preferred wall mounting bracket. Mounting the rods to a ceiling would require the adjustments previously discussed (following the description of FIG. 1B and before the descriptions of FIGS. 2-4).

FIG. 9A is a top view of Type 1 component rods that combine dual-drapery rod components with the preferred single-drapery rod of FIG. 5. Single-drapery rod 64 is comprised of telescopically engaged back center rods 63L and 63R. Left and right curved rods 71L and 71R are comprised of curved segments 74L and 74R sandwiched between substantially straight left and right back segments 73L and 73R and left and right front segments 75L and 75R, the latter sized appropriately to just support accent drapery and leave an unobstructed view of the primary drapery in back. The dual-drapery rod is assembled by telescopically inter-engaging 63L with 73L while aligning apertures 39L and telescopically inter-engaging 63R with 73R while aligning apertures 39R, keeping rods 71L and 71R in substantially the same plane. The back section of the assembled rod is comprised of 73L, 63L, 63R, and 73R; the intermediate sections by 74L and 74R; and the front sections by 75L and 75R.

FIG. 9B is a top view of Type 2 component rods that also combines the single-drapery rod shown in FIG. 5 with dual-drapery rod components having curved segments sandwiched between substantially straight back and front segments. However, front segments 75L' and 75R' of 71L' and 71R' are extended so they engage when 73L' and 73R' are telescopically engaged with inter-engaged rods 63L and 63R and apertures are properly aligned.

The embodiments of FIGS. 10-12 combine one of the single-drapery rods shown in FIGS. 5-7 with dual-drapery rod components similar or identical to those included in the embodiments of FIGS. 3-4.

FIG. 10A is a top view of Type 1 component rods that combine the preferred single-drapery rod of FIG. 5 with dual-drapery rod components similar or identical to those shown in FIG. 3A. The embodiment of FIG. 10A, like 3A, includes curved rods 53L and 53R comprised of left and right curved segments 55L and 55R sandwiched between substantially straight back segments 54L and 54R and front segments 56L and 56R as well as left and right front rods 44L and 44R. Single drapery rod 64, comprised of back center rods 63L and 63R, is similar to 52L and 52R in FIG. 3A but with apertures. Back center rods 63L and 63R are assumed to have the same inside and outside circumferences as back center rods 52L and 52R of FIG. 3A and thus are assumed to be telescopically equivalent.

The drapery rod of FIG. 10A is assembled by telescopically engaging 63L with 54L while aligning apertures 39L; telescopically engaging 63R with 54R while aligning apertures 39R; and telescopically engaging 56L with 44L and 56R with 44R. The back section of the assembled dual-drapery rod is comprised of 54L, 63L, 63R, and 54R; the intermediate sections are comprised of 55L and 55R; and the left and right front sections are comprised of 56L and 44L and 56R and 44R.

FIG. 10B is a top view of Type 2 component rods that combine the preferred single-drapery rod of FIG. 5 with dual-drapery rod components similar or identical to those shown in FIG. 3B. Front rods 44L and 44R of FIG. 10A are replaced with 63L' and 63R', which are identical to 52L' and 52R' in FIG. 3B and similar to 63L and 63R in FIG. 13B but have no apertures. 63L' and 63R' telescopically engage each other and 56L and 56R to form a continuous front section capable of supporting fully drawn primary drapery.

FIG. 11A is a top view of Type 1 component rods that combine the single-drapery rod of FIG. 6 with the two curved rods 59L and 59R and two substantially straight left and right front rods 34L and 34R of embodiment shown in FIG. 4A. Back center rod 68 is telescopically inter-engaged with left and right rods 66L and 66R to form the single-drapery rod of FIG. 6. The dual-drapery rod is formed by telescopically engaging 60L with 66L while aligning apertures 39L; telescopically engaging 60R with 66R while aligning apertures 39R; and telescopically engaging 34L with 62L and 34R with 62R. Rods 66L, 68, and 66R and segments 60L and 60R form the back section; curved segments 61L and 61R form the intermediate section; 62L and 34L form the left front section; and 62R and 34R form the right front section.

FIG. 11B is a top view of Type 2 component rods that combine the single-drapery rod of FIG. 6 with dual-drapery rod components similar or identical to those shown in FIG. 4B. This Type 2 embodiment is identical to the Type 1 embodiment of FIG. 11A except that front center rod 37 is added and telescopically inter-engaged between front rods 34L and 34R to form a continuous front section capable of supporting fully drawn primary drapery.

FIG. 12A is a top view of the components of a Type 1 dual-drapery rod that combines the single-drapery rod embodiment of FIG. 7 with the two curved rods 59L and 59R and two front rods 34L and 34R of the dual-drapery rod embodiment of FIG. 4A. Unitary single-drapery rod 69 is telescopically engaged with 60L while aligning apertures 39L in the two rods; 60R is telescoped with 69 while aligning apertures 39R; rod 34L is telescoped with segment 62L; and 34R is telescoped with 62R. The back section of the assembled rod is formed by 60L, 69, and 60R, the intermediate section by segments 61L and 61R of curved rods 59L and 59R, and the left and right front sections by 62L and 34L and 62R and 34R.

FIG. 12B is a top view of the components of a Type 2 dual-drapery rod that combines the single-drapery rod of FIG. 7 with dual-drapery rod components similar or identical to those shown in FIG. 4B. Those components are identical to the components of the Type 1 embodiment of FIG. 12A except that front center rod 37 (also included in the embodiment shown in FIG. 4B) is added. Front center rod 37 telescopes with 34L and 34R to bridge the gap between front sections and create a front section suitable for the primary drapes.

All of the above have circular apertures that cooperate with the cylindrical third members of the preferred bracket of FIGS. 1A and 1B. However, third members and corresponding apertures of different cooperating shapes are also possible, and may be preferred when apertures are formed with non-slip brackets rather than within the drapery rod itself. FIG. 13 shows the preferred embodiment of the single-drapery rod with non-slip brackets and comprised of telescoping substantially straight rods 71L' and 71R' together. Non-slip brackets attach to 70 at points substantially adjacent to the single-drapery rod's ends. Non-slip brackets 72L and 72R arch away from and back into the rods to form substantially perpendicularly disposed apertures 79L and 79R. Wall mounting brackets 76L and 76R attach to a wall or other substantially vertical support surface and cooperate with the surrounding surfaces of apertures between non-slip brackets 72L and 72R and rods 71L' and 71R' to secure the single-drapery rod.

FIG. 14A is a perspective view of the non-adjustable version of the wall mounting bracket that cooperates with non-slip brackets. Wall mounting bracket 76 includes a first member comprised of a base plate 85 with a vertically elongated body, a second member 86 having a horizontally elongated body extending substantially perpendicularly from base plate 85, and a third member 88 having a vertically elongated body extending upwardly and substantially perpendicularly from second member 86. The three members may be formed from a single elongated plate or made from two or more plates attached together using some method such as welding, brazing, or fusion. First member 85 is adapted to attach to a wall or other vertical support surface using screws, wall anchors, or other attachment means (not shown) while second member 86 engages the bottom surface of the non-slip brackets and third member 38 engages the surrounding surfaces of the apertures created by the opposing surfaces of the non-slip bracket and drapery rod.

FIG. 14B is a perspective view of the adjustable version. Second member 86' of adjustable wall mounting bracket 76' is comprised of upper and lower second members 86A' and 86B'. Longitudinally disposed channel 87C in 86B' cooperates with an adjustment screw (not shown) operated with an attached head 87S to adjust 86' for desired clearance from the support surface without the need for tools. 87S is turned to loosen the screw and allow 86A' to be extended or retracted along 87C, with the range of motion being determined by the length of 87C. 87S is turned to tighten the screw at the appropriate point for desired clearance from the support structure.

Although many single and dual-drapery rod embodiments have been shown and described, additional ones are possible. Apertures, non-slip brackets, and cooperating third members could be reshaped, and a number of additional dual-drapery rod component configurations could be used. However, the embodiments described here should be sufficient to illustrate the principles and implementations of the non-mechanized multi-purpose drapery rod assembly and make its nature, objects, and advantages apparent to those skilled in the art. The embodiments displayed and described below illustrate the motorization of this system.

FIGS. 15-20 show assemblies that convert a conventional traverse rod into a motorized single or dual-drapery rod mounted on the preferred wall mounting bracket. The structure and operation of the traverse rod are described only to the extent necessary for context. Detailed descriptions of the traverse rod and its operation are available not only from early patents but also from a variety of readily available sources such as instructions that typically come with the rod and are available on how-to internet sites.

FIG. 15 is a perspective front view of the components of a right-engaging motorized single-drapery rod assembly with a partial view of a cooperating traverse rod. (The placement of the assembly on the right side is arbitrary. A left-engaging assembly using the same components rearranged is also possible.) The assembly is less complex structurally than prior art and does not require the transmission cord to be redirected before it is wound around the motor's wheel or drive pulley. Prior art employs multiple wheels and/or clips with channels to redirect the cord vertically before engaging a pulley wheel, then redirects it back horizontally before the cord re-enters the traverse rod (e.g., see US 2006/0162877 A1 and 7360576 B2). This increases the complexity of the assembly and may decrease efficiency and contribute to slippage. U.S. Pat. No. 7,360,576 B2 purports to combat the slippage problem, but still requires redirection of the transmission cord and appears to increase rather than decrease structural complexity.

Referring to FIG. 15, a traverse rod aperture 114R penetrates the front surface of drive pulley housing 104 which contains a drive pulley 105 with a drive pulley groove 106 to receive a transmission cord (shown in FIG. 18) from traverse rod 108. Reverse electric motor 110 is positioned in front of and coupled with right-angled drive 112 to rotate 105. Rubber (not shown) coats 106 to increase traction of the transmission cord. Traverse rod aperture 114R is sized to receive the right end of horizontally disposed traverse rod 108 while said traverse rod's transmission cord is wound around 106 of drive pulley 105 (which replaces the traverse rod's right pulley and cord tension pulley). Since 105 is directly across from the open end of traverse rod 108 when the rod is inserted horizontally into aperture 114R, the traverse rod's transmission cord does not have to be redirected before winding around 106. A set screw (not shown) tightens to hold the traverse rod in place.

Wall mounting bracket 126R cooperates with a support aperture (shown in FIG. 16) penetrating the bottom surface of 104 to support the assembly. 126R is structurally identical to the preferred wall mounting bracket shown in FIG. 1A, with a first member comprised of a base plate 135R having a vertically elongated body, a second member 136R having a horizontally elongated body extending substantially perpendicularly from 135R, and a third member 138R having a vertically elongated cylindrical body extending upwardly and substantially perpendicularly from 136R. Base plate 135R is adapted to attach to a wall or other vertical support surface while 136R engages the bottom surface of 104 and third member 138 engages the surrounding surfaces of support aperture 118R (see FIG. 16), thereby mounting the assembly and the right end of the traverse rod to a support surface. (The left end of the traverse rod is supported with a traditional traverse rod support bracket not shown). Face plate 115 attaches to the face of 104. Small apertures penetrate the face and end of 104 and intersect with like apertures penetrating its bottom surface to receive drapery hooks that are used with traverse rods (not shown). This allows drapery that is hung from the traverse rod to also be hung across the face and around the back end of housing 104.

FIG. 16 is a perspective view from below and behind drive pulley housing 104. Support aperture 118R penetrates the bottom surface of 104 at an angle substantially perpendicular to traverse rod 108. 118R is sized to receive third member 138R of 126R while second member 136R engages the bottom surface of 104 and 135R engages a wall. Aperture 122R is sized to receive a dual-drapery rod (see FIG. 17) and may be capped when not in use.

FIG. 17 is a back perspective partial view of a motorized dual-drapery rod conversion assembly with cooperating traverse rod and right dual-drapery rod. Dual-drapery rod 120R is comprised of segment 123R curved 180 degrees and sandwiched between substantially straight front and back segments 121R and 125R. Substantially straight front rod 127R telescopically engages with 121R to provide an adjustable support for accent drapery (not shown). Housing 104 is shown assembled with electric motor 110 and right angled drive 112. Right dual-rod housing aperture 122R is sized to receive 125R and penetrates the back end of 104 a distance greater than the diameter of back segment 125R. In-rod aperture 124R in turn penetrates through the top and bottom surfaces of 125R at an angle substantially perpendicular to the plane of 120R and is sized and shaped to receive third member 138R. 125R is inserted into aperture 122R and third member 138R is inserted through apertures 118R (see FIG. 16) and 124R. Apertures 118R (FIG. 16) and 122R penetrate into 104 far enough to intersect and leave rigid surrounding surfaces beyond the intersection. Third member 138R is long enough to engage rigid surrounding surfaces above as well as below the intersection so that it secures dual-drapery rod 120R in a substantially horizontal plane and prevents 104 from rotating while second member 136R engages the bottom surface of 104 to prevent vertical movement.

Conversion to a motorized dual-drapery rod requires a second housing and dual-drapery rod. FIG. 18 provides a front view of take-up pulley housing 129 and drive pulley housing 104 with traverse rod 108 in between. Traverse rod 108 is separated in the middle to better show transmission cord 132, which wraps around take-up pulley 130 and drive pulley 105. Mounting brackets 126L and 126R are also separated from the housings, as are face plates 115 and 116 and cord guard 128 for take-up pulley 130. Cord guard 128 keeps transmission cord 132 from slipping off pulley 130. The ends of cord 132 are not shown, but are drawn tight and tied off at the traverse rod carriers as described in standard instructions accompanying the rods. A tension spring (not shown) is used at one end to maintain tension on the cord.

FIG. 19 is a left front perspective partial view of take-up pulley housing 129 attached to traverse rod 108 but separated from dual-drapery rod 120L and mounting bracket 126L. Transmission-cord guard 128 has also been separated from pulley 130 and front surface plate 116 has been removed to better display the take-up pulley. Aperture 114L (not shown) is sized like 114R shown in FIG. 15 to receive the end of traverse rod 108 while the traverse rod's transmission cord winds around take-up pulley 130 (see FIG. 18). Dual-drapery rod 120L is comprised of segment 123L curved 180 degrees and sandwiched between substantially straight front and back segments 121L and 125L. Left dual-rod housing aperture 122L penetrates the back end of 129 and is sized to receive 125L. In-rod aperture 124L in turn penetrates through the top and bottom surfaces of 125L and is sized to receive third member 138L. 125L is inserted into aperture 122L and third member 138L is inserted through apertures 118L penetrating the bottom of 129 (not shown) and 124L. Apertures 118L and 122L penetrate far enough into 129 to intersect. Third member 138L is long enough to engage rigid surrounding surfaces above as well as below the intersection so that it secures dual-drapery rod 120L in a substantially horizontal plane and prevents housing 129 from rotating while second member 136L engages the bottom surface of 129 to prevent vertical movement. A substantially straight front rod (not shown) may be telescopically engaged with the front segment of the dual drapery rod as shown in FIG. 17.

FIG. 20 is a perspective front exploded view of a second embodiment of the drive pulley apparatus with other key components and a partial view of a cooperating traverse rod. The second embodiment is more complex than the first, incorporating additional parts designed to deal with the cord slippage problem common with motorized drapery rod assemblies. Traverse rod aperture 114R penetrates the front surface of drive pulley housing 107 containing a drive pulley with a large-diameter portion 109 and a smaller-diameter groove portion 111. 111 receives transmission cord 132 from traverse rod 108. Reverse electric motor 110 is again positioned in front of and coupled with right-angled drive 112. Traverse rod aperture 114R (not shown) is sized to receive the left end of 108 while transmission cord 132 is wound around 111. Friction wheel 140 and tension bushing 142 have holes in their centers which allow 140 and 142 to fit tightly around 111. 111 is threaded at its end to receive tension nut 146. 140 is first fitted over 111 and up against 132, then 142 is fitted over 111 and up against 140. A tension spring 144 is then slipped over 111 and held in place by 146, which is tightened to create desired tension to prevent slippage of 132. Tension cap 148 attaches to 107 with screws and includes a tension cap crown 149 which provides clearance for 111. As before, right dual-rod housing aperture 122R receives the end of the back segment of dual drapery rod 120R (see FIG. 17). Wall mounting bracket 126R supports the assembly, third member 138R engaging the surrounding surfaces of support aperture 118R (see FIG. 16) while second member 136R engages the bottom surface of 107 (not shown) and 135R engages a wall.

The invention claimed is:

1. A drapery rod assembly comprising:

a drapery rod made of a rigid material with a top and bottom surfaces, a mounting bracket, and first and second apertures each extending through said drapery rod at a pre-determined angle;

a. said mounting bracket is comprised of a first member base plate, a second member extending away from said base plate, and a third member comprised of an element having a base and a distal end extending away from said second member;

b. said base plate being adapted to engage a support surface and including connecting means to attach said base plate to said support surface;

c. and said third member being sized and shaped to engage inside surfaces surrounding the drapery rod apertures;

d. said third member being disposed at said pre-determined angle when said base plate is attached to said support surface;

left and right curved rods having curved segments disposed between substantially parallel left and right front and back segments;

and said first and second apertures extend through said left and right back segments, respectively; and whereby said left and right back segments are each sized and dimensioned to adjustably engage a single drapery rod.

2. The drapery rod assembly of claim 1 wherein the distance between said substantially parallel front and back segments is no more than 3½ inches.

3. The drapery rod assembly of claim 2 wherein said third member is disposed upwardly when said base plate is attached to said support surface.

4. The drapery rod assembly of claim 2 wherein a. said apertures extend through said top and bottom surface of said drapery rod;

b. said third member is also comprised of a removable collar or pin on said distal end of said third member; and c. said third member engages the inside surrounding surfaces of said apertures while said removable collar of said third member engages said bottom surface of said drapery rod when said base plate is attached to said support surface.

5. The drapery rod assembly of claim 2 wherein said third member is disposed in a substantially horizontal plane when said base plate is attached to said support surface.

6. The drapery rod of claim 2 wherein a. said drapery rod is further comprised of a drive pulley and a take-up pulley housing with a front and back end;

b. said drapery rod assembly includes a motorized assembly comprised of a reverse electric motor and a right-angled drive connected to the drive pulley housed in said drive pulley housing;

c. said drive and take-up pulleys have grooves sized and adapted to receive a transmission cord from a traverse rod and hold it within said grooves, thereby allowing said motor to release and drawback said cord;

d. a traverse rod aperture penetrates said front surface of said drive and take-up pulley housings;

e. each said traverse rod aperture is sized and shaped to receive and engage one end of said traverse rod when said traverse rod is disposed in a substantially horizontal direction;

f. said drapery rod apertures extend through said bottom surface of said drive pulley and take-up pulley housings at a substantially perpendicular angle to said traverse rod and substantially adjacent to said back end of said housings;

g. said drapery rod apertures also extend through said top and bottom surfaces of said back segments of said curved rods at a substantially perpendicular angle;

h. said second member of said mounting bracket extends away from said base plate at a substantially perpendicular angle, and said third member extends from said second member upwardly and at a substantially perpendicular angle from said second member;

i. said third member engages the surrounding surfaces of said drapery rod aperture while said second member engages said bottom surface of said housings, thereby securing said housings from movement when said base plate is attached to said support surface;

j. said assembly is further comprised of dual-rod housing apertures sized to receive the ends of said back segments;

k. said dual-rod housing apertures extend through said back ends of said drive-pulley and take-up pulley housings a distance that exceeds the outside diameter of said back segments;

l. said drapery rod apertures and said dual-rod housing apertures extend into the housings far enough to intersect and leave rigid surrounding surfaces beyond the intersection;

m. said left and right curved rods are telescoped into said dual-rod housing apertures while aligning said drapery rod apertures in said back left and right segments with said drapery rod apertures in said housings;

n. said third members of said wall mounting brackets are sized to penetrate through said dual-rod housing apertures and said drapery rod apertures and engage said rigid surrounding surfaces beyond the intersection of the apertures, whereby said left and right curved rods are secured to said housings in a substantially horizontal plane when said base plate is attached to said wall.

7. The assembly of claim 6 wherein said left and right front segments of said curved rods telescopically engage with substantially straight left and right front rods.

8. The drapery rod assembly of claim 6 wherein said drive pulley is a split-groove pulley with a friction wheel, tension bushing, tension spring, and a threaded end to receive a tension nut;

a. said drive pulley includes a large-diameter portion and a groove portion, said large-diameter portion having a larger diameter than said groove portion;

b. said large-diameter portion is located between said right angled drive and said groove portion;

c. said groove portion has a smaller diameter than said friction wheel and tension bushing;

d. center holes in said friction wheel and tension bushing permit said wheel and bushing to fit tightly over said groove portion, said friction wheel fitting over said groove portion and up against said transmission cord and said tension bushing fitting over said groove portion and up against said friction wheel;

e. said tension spring fits over said groove portion; and f. said tension nut is threaded onto the end of said groove portion and tightened, compressing said spring and increasing tension as necessary to prevent transmission cord slippage.

9. The drapery-rod assembly of claim 2 wherein said left and right curved segments comprise curved left and right intermediate sections, and wherein said front and back segments comprise front and back sections of said drapery-rod;

a. said left and right intermediate sections are curved toward each other in a substantially horizontal plane approximately 180° over a predetermined distance, thereby aligning said left and right front sections in a substantially straight line the desired distance from and substantially parallel to said left and right back sections;

b. said apertures extend through said left and said right back sections at said pre-determined angle to the plane of said intermediate sections; and whereby said left and right back sections are adapted to telescopically engage an existing single drapery rod to form a dual-drapery rod, said dual-drapery rod being adapted to be secured in a substantially horizontal plane when 1) said base plate of said mounting bracket is attached to said support surface and 2) said third member is engaged with said inside surrounding surfaces of said apertures.

10. The drapery rod assembly of claim 9, wherein said drapery rod is comprised of a plurality of telescopically engageable rods including said left and right curved rods;

wherein said back segments are adapted to adjustably telescope with said single drapery rod;

wherein said apertures extend through said left and said right back segments at points substantially adjacent to each of said curved segments;

and wherein said dual-drapery rod is sized and dimensioned to receive a first and second set of drapery, wherein said first set is supported on said telescopically engaged single-drapery rod and back segments, and wherein said second set is supported on said front and intermediate sections.

11. The drapery rod assembly of claim 10, wherein said front sections of said drapery rod further comprise substantially straight left and right front rods sized and dimensioned to telescopically engage with said front segments of said left and right curved rods; and wherein said left and right front rods and said left and right front segments are telescopically adjustable;

whereby said left and right front sections of said drapery rod are adjustable.

12. The assembly of claim 10 wherein said engageable rods include a substantially straight front center rod sized and dimensioned to telescopically engage said front segments of said left and right curved rods;

whereby said front section of said drapery rod is adapted to support fully drawable front drapery.

13. The drapery-rod assembly of claim 10 wherein a. said apertures also extend through said single-drapery rod substantially adjacent to said left and right ends;

b. said back sections are adapted to engage said single-drapery rod while said apertures extending through said back sections are aligned with said apertures extending through said single-drapery rod.

14. The drapery rod assembly of claim 13 wherein said drapery rod also includes substantially straight left and right front rods engaged with said left and right front segments of said curved rods.

15. The drapery rod assembly of claim 13 wherein said drapery rod also includes a substantially straight front center rod sized and dimensioned to telescopically engage said front segments of said left and right curved rods;

whereby said front section of said drapery rod is adapted to support fully drawable front drapery.

16. The drapery rod assembly of claim 9, wherein said aperture extends through said left and said right back segments at points substantially adjacent to each of said curved segments and at said pre-determined angle to the plane of said curved rods;

wherein said back segments of said left and right curved rods are adapted to adjustably telescope and engage said single drapery rod to form said dual-drapery rod;

and wherein said dual-drapery rod is adapted to be attached to two sets of drapery, said single-drapery rod engaged with said back segments of said curved rods being configured to receive the first set of drapery, and said front and curved segments being configured to receive said second set of drapery.

17. The drapery rod assembly of claim 9 further comprising left and right front rods;

wherein said apertures extend through said back segments at points substantially adjacent to each of said curved segments and at said pre-determined angle to the plane of said curved rods;

wherein said left and right front rods are sized and dimensioned to telescopically engage said front segments of said left and right curved rods;

wherein said left and right front rods and said left and right front segments are telescopically adjustable;

wherein said back segments are adapted to telescopically engage a single drapery rod to form a dual-drapery rod, said dual-drapery rod being adapted to be attached to two sets of drapery; and whereby said single-drapery rod and back segments of said curved rods are configured to receive the first set of drapery, and said curved segments and said front segments adjustably telescoped with said front rods are configured to receive said second set of drapery.

18. The drapery rod assembly of claim 2, wherein said back segments are substantially longer than said front segments.

19. The drapery rod assembly of claim 2, wherein said front segments are substantially longer than said back segments.

20. The drapery rod assembly of claim 2, wherein the length of said back segments is at least a combined 13 inches.

* * * * *